US005790096A

United States Patent [19]

Hill, Jr.

[11] Patent Number: 5,790,096

[45] Date of Patent: Aug. 4, 1998

[54] AUTOMATED FLAT PANEL DISPLAY CONTROL SYSTEM FOR ACCOMODATING BROAD RANGE OF VIDEO TYPES AND FORMATS

[75] Inventor: Jacques R. Hill, Jr., Houston, Tex.

[73] Assignee: Allus Technology Corporation, Houston, Tex.

[21] Appl. No.: 707,338

[22] Filed: Sep. 3, 1996

[51] Int. Cl.[6] ..... G09G 5/00

[52] U.S. Cl. ..... 345/150; 345/147; 345/153; 345/154; 348/441; 348/443; 348/387

[58] Field of Search ..... 345/20, 127, 131, 345/147, 150, 153, 154, 211, 214; 348/387, 441, 443, 460, 525, 529, 530, 531

[56] References Cited

U.S. PATENT DOCUMENTS

| | | | |
|---|---|---|---|
| Re. 33,532 | 2/1991 | Ishii | 345/148 |
| 4,841,289 | 6/1989 | Kambayashi et al. | 345/150 |
| 4,998,165 | 3/1991 | Lindstrom | 345/150 X |
| 5,119,086 | 6/1992 | Nishioka et al. | 345/147 |
| 5,299,306 | 3/1994 | Asprey | 375/257 |
| 5,327,243 | 7/1994 | Maietta et al. | 348/565 |
| 5,334,992 | 8/1994 | Rochat et al. | 345/150 X |
| 5,442,375 | 8/1995 | Wojaczynski et al. | 345/147 |
| 5,446,496 | 8/1995 | Foster et al. | 348/441 |
| 5,576,723 | 11/1996 | Asprey | 345/153 X |
| 5,606,348 | 2/1997 | Chiu | 345/213 |

*Primary Examiner*—Steven J. Saras
*Assistant Examiner*—Seth D. Vail
*Attorney, Agent, or Firm*—Gerald E. Lester

[57] ABSTRACT

An electronics control system for full color and monochrome flat panel displays which automatically accommodates video signals of numerous types and formats, whether interlaced, non-interlaced, composite, or video signals with separated sync signals. Display of such video signals on a wide selection of flat panel display systems also is accommodated. Incoming and output video rates are asynchronous. Plug-in modules allow the system to convert video signals of numerous types and modes for display on any flat panel display system. Images are both automatically, and under user control, up-sized and down-sized, positioned and oriented to fit the flat panel display being used. Color images are automatically reduced to grey scale monochrome when a monochrome flat panel display is being used. Push-pull A/D converter circuitry for digitizing color video signals is used to reduce cost while conserving power. A further power saving feature provides for automatic power down when video reception is interrupted, and power up when the video reception is reacquired.

36 Claims, 18 Drawing Sheets

AUTOMATED FLAT PANEL DISPLAY CONTROL SYSTEM FOR ACCOMODATING BROAD RANGE OF VIDEO TYPES AND FORMATS

FIELD OF THE INVENTION

The invention relates generally to flat panel display control systems, and more specifically to electronic control systems for accepting video signals of numerous formats and types, and for displaying such video signals on a wide variety of flat panel displays.

BACKGROUND OF THE INVENTION

The use of flat panel displays is well known. See U.S. Pat. Nos. 5,285,192; 5,193,069; 5,150,109; 5,293,485; 4,922,237; 5,442,371; 4,990,904; and 4,990,902. Further, electronic control systems for flat panel displays are known which can accommodate either interlaced or non-interlaced video signals, and which can separate out horizontal and vertical sync signals from a video signal. See U.S. Pat. Nos. 5,227,882; 5,442,371; and 5,327,240.

In addition, flat panel electronic control systems are known which can up-size a video image to fit a particular display, or center a small image within a larger screen. See U.S. Pat. Nos. 5,267,045; 5,285,192; and 4,990,902. The system disclosed in U.S. Pat. No. 5,267,045 is defective, however, in that it performs sizing by varying the video rate as the video data is being stored. As a result, pixel data is lost and image resolution is compromised. Further, U.S. Pat. No. 5,295,192 performs upsizing only, and does not accommodate down sizing. U.S. Pat. No. 4,990,902 only centers an image in accordance with a table look-up of fixed data.

Still further, electronic control systems for flat panel displays are known which accommodate color to color, and color to monochrome processing of video signals. See U.S. Pat. Nos. 5,193,069; 5,293,485; and 4,922,237. While U.S. Pat. No. 5,193,069 refers to and claims a color to grey scale conversion, the patent fails to disclose how such a conversion is accomplished. U.S. Pat. No. 5,293,485 discloses a complex system which uses a color palette in supplying color signals to a computer CRT. The system cannot support NTSC, PAL or HDTV video formats. U.S. Pat. No. 4,922,237 discloses a character conversion only, and cannot perform color to monochrome conversions for graphics. Electronic control systems for flat panel displays also are known which accommodate one or more of PAL, HDTV, NTSC, and VGA RGB video signals in driving the display.

U.S. Pat. No. 5,313,225 discloses a flat panel display which automatically turns off a back light when video signals are not being received. The patent does not disclose either a system for turning the power back on when video signals reappear, or a power conserving sequencing system for a flat panel electronic control system.

U.S. Pat. No. 5,327,240 is mentioned only as a reference exercising pixel by pixel control to achieve high resolution displays of images.

U.S. Pat. No. 5,227,882 also refers to and claims a capability to automatically detect video formats and provide asynchronous video input and output. Nowhere does the patent describe or illustrate how these feats are accomplished. In fact, the system is incapable of asynchronous operation as the disclosed system for outputting video data is dependent on the input read rate.

Lastly, U.S. Pat. No. 5,193,069 discloses a portable computer system for plugging a number of displays into a same electronics board connector. As the system is computer based and has only one electronics board connector, it cannot support NTSC, PAL or HDTV systems.

In accordance with the invention, images on a flat panel display may be upsized, downsized, positioned and oriented automatically or through use of user controls. Further, monochrome to color, color to monochrome, color to color, and monochrome to monochrome video processing is accommodated. Still further, power to the electronic control system is sequentially turned on and off for power conservation as video appears, disappears, and reappears.

In addition, in accordance with the invention, video data may be received at the video rate and asynchronously output to a flat panel display at the display rate without any loss of resolution. Further, both video formats and types are automatically detected.

The present invention also provides plug-in modules for an input video connector at which video is received, for color frame buffers where image content is stored, and for a flat panel interface module to which a flat panel display attaches. All known flat panel displays, and video formats and types for flat panel displays may be accommodated without compromising power conservation. The above and other aspects of the invention are summarized below.

SUMMARY OF THE INVENTION

An electronic control system is disclosed which automatically identifies video signal type, format, and resolution, and adapts the video image for display on a wide variety of full color and monochrome flat panel display systems.

In one aspect of the invention, an image processing system is employed to accept any video format including VGA, SVGA, XGA, NTSC, PAL, SECAM, and all other forms of RGB video, either interlaced or non-interlaced, with composite or separate synchronization signals, and to convert the video image for display on any full color or monochrome flat panel display system being used.

In another aspect of the invention, the microprocessor of the electronic control system can automatically detect and accommodate a change in format, for example a change between NTSC and PAL formats, and determine whether a video image is interlaced or non-interlaced. The microprocessor also can detect various VGA video modes such as, by way of example only, 640×480, 800×600, 1024×768, 1280×1024 pixels.

In yet another aspect of the invention, the video image may be up-sized or down-sized, and positioned to fit the video screen of the flat panel display being used. These functions may be controlled automatically or by means of user controlled analog and/or digital configuration switches. Further, the video image may be rotated in 90° increments for presentation in portrait form, or rotated 180° to accommodate LCD displays with different optical vertical viewing cycles, or presented in mirror-image form for use in overhead projection systems.

In a further aspect of the invention, full color images may be reduced to a plural bit grey scale for display on a monochrome screen. Further, monochrome to monochrome, monochrome to color, and color to color image processing also is provided.

In still another aspect of the invention, the versatility of the electronic control system accommodates plug-in option modules for easy reconfiguration of the system to meet different needs. For example, the red and blue color frame buffers of the electronic control system may be unplugged when monochrome video data is being processed. Also numerous plug-in video input module options may be interchanged to accommodate different video types. Further, numerous plug-in module options for use with the flat panel interface module may be interchanged to provide different electronic interfaces for compatibility with different flat panel displays, including LCD, electroluminescent, gas plasma, and FED display systems.

In a further aspect of the invention, push-pull A/D converter circuits are used to reduce cost while conserving power in digitizing video signals.

In a still further aspect of the invention, all components of the electronic control system except the microprocessor are shut down when video signal reception is absent or lost, and powered up only when video reception is verified. Other power saving features include the use of low power components in the electronic control system, and both automated and manual controls for controlling backlight intensity.

In yet a further aspect of the invention, analog and digital controls are provided to allow a user to make adjustments of backlight intensity, image contrast, horizontal and vertical image positioning, image focus, image size, image orientation, and color reduction.

In another aspect of the invention, video signals are accepted at the incoming video rate and asynchronously output at the flat panel display rate.

DESCRIPTION OF THE DRAWINGS

The accompanying drawings, which are incorporated in and constitute a part of the specification, illustrate a preferred embodiment of the invention, and together with the general description given above and the detailed description of the preferred embodiment given below, serve to explain the principles of the invention.

DESCRIPTION OF PREFERRED EMBODIMENTS

The features, advantages and objects of the invention will become more readily apparent from the following detailed descriptions when taken in conjunction with the drawings as described above.

In the description which follows, like components and parts are referred to by same reference numbers. Further, the following definitions apply throughout the specification:

Line: As referred to herein, a line is an electrical conductor.

Video Line: A horizontal video line also referred to as a row or video row.

Frame: A set of rows (lines) and columns that describe a video image. Also referred to as a video frame.

Interlace: Interlaced video is where a first frame of video contains only the odd rows (video lines), e.g., 1, 3, 5, etc., and the second frame of video contains only the even rows (video lines), e.g., 2, 4, 6, etc. Interlaced video requires two complete frames of video to completely describe an image.

Video Type: The physical type of video source including (i) composite video where the picture signal and the sync signals are combined into one signal, and (ii) component video where the picture signals (red, green and blue) are separate, and the sync signals are either separate or combined with a picture color signal.

Video Format (Modes): The timing characteristics of a video type including number of rows and columns, frames per second, and whether the video lines are interlaced or non-interlaced. Formats for composite video include (i) NTSC (National Television Standards Committee) with 525 lines of video interlaced at 60 Hz, (ii) PAL (Phase Alternating Line) with 625 lines of video interlaced at 50 Hz, (iii) HDTV (High Definition Television) which currently has no universally accepted format but as used herein has 1125 lines of video at 100 Hz, and (iv) numerous variations of NTSC and PAL. Formats for component video include (i) RGB (sync on green) in NTSC, PAL or other video format; (ii) RGB (sync on green) in non-interlaced format at different numbers of lines and columns; (iii) VGA with 640×480 non-interlaced video at 60 Hz, 720×400 non-interlaced video at 60 Hz, and 640×350 non-interlaced video at 60 Hz, (iv) SVGA with 800×600 non-interlaced video, (v) XGA with 1024×768 non-interlaced video, and (vi) SXGA with 1280×1024 non-interlaced video.

Figure 1:
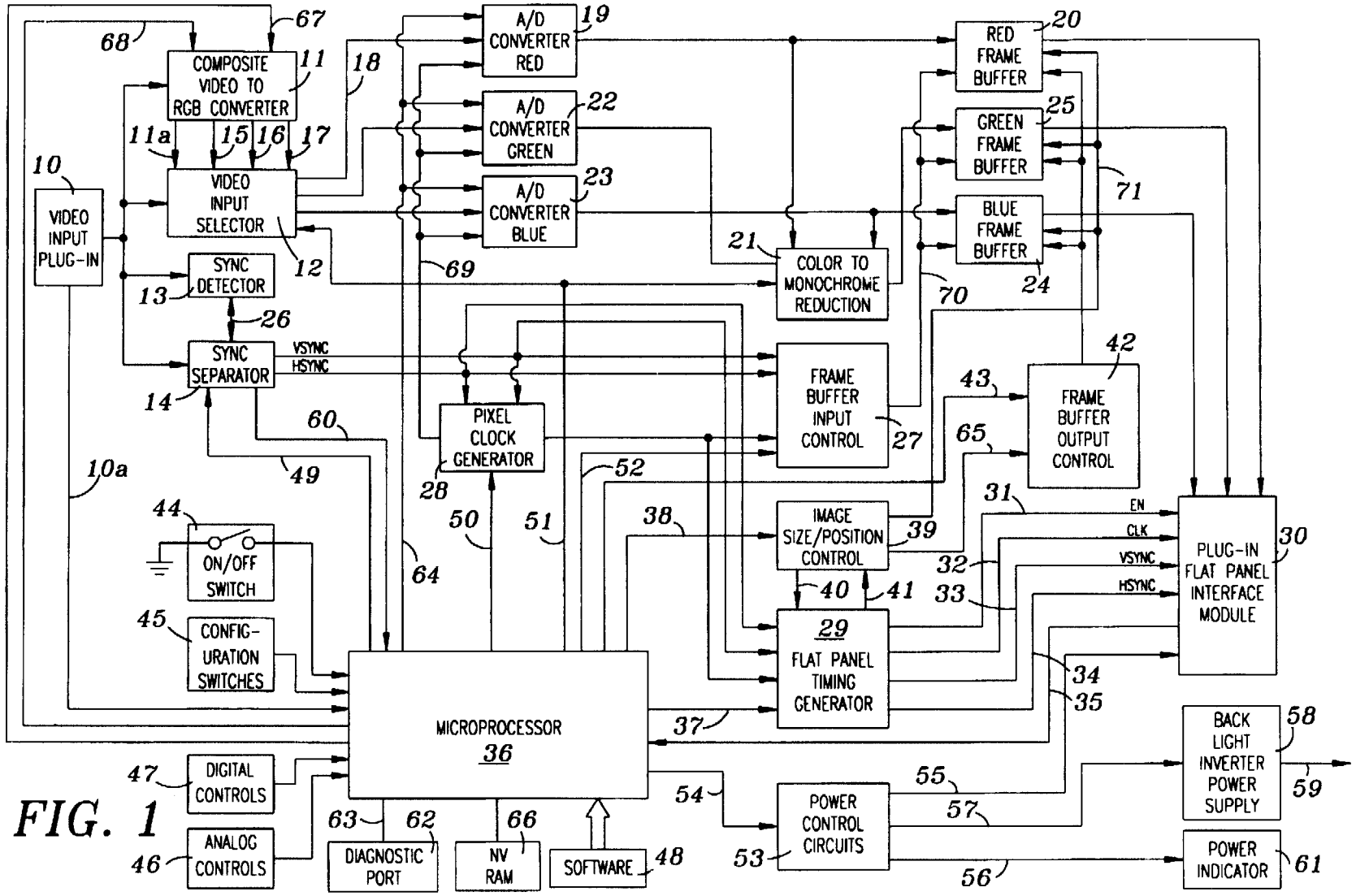
FIG. 1 is a functional block diagram of an electronic control system in accordance with the present invention.

Referring to FIG. 1, a video signal is applied by way of a video input connector 10 to one input each of a composite video to RGB converter 11, a video input selector 12, a sync detector 13, and a sync separator 14. Red, blue and green color signals are issued by the converter 11 respectively on lines 15, 16 and 17 leading to additional inputs of the selector 12.

The video input connector 10 is a plug-in physical interface which may be interchanged with a plurality of other plug-in input connectors to accommodate a wide variety of video input types including a 15 pin VGA connector, and BNC or RCA type connectors. The connector 10 includes a unique code that is issued on line 10*a* to the microprocessor 36 to identify the video format and type which is being accepted, as will be describe in more detail below in the description of Table VI.

The converter 11 is active only when composite video is being processed, and acts to separate the chrominance of a full color composite video signal into its red, green and blue components as respectively applied to lines 15, 16 and 17. The black-and-white information called luminance is also separated from the composite video signal, and applied by way of a line 11*a* to a further input of the video input selector 12.

The selector 12 responds to the microprocessor 36, as further explained in more detail below, to select between video signals supplied by the video input connector 10 and video signals received by way of the converter 11. Further, the selector includes a selectably variable precision voltage reference that is used to determine the digitizing range of a received video signal, and thereby allow video signals of small amplitude to appear as if they were being received at full signal amplitude. The variable voltage reference also allows the system to process other video sources with different input signal levels.

Selector 12 also applies an analog signal indicating red color to line 18, and through an analog to digital (A/D) converter 19 to inputs of an eight bit red color frame buffer 20 and a color to monochrome reduction device 21. The reduction device 21 processes the incoming video in accordance with weighting formulas supplied by the microprocessor to provide monochrome to monochrome, monochrome to color, color to monochrome, and color to color transitions. The weighting formulas are explained in more detail below in connection with the description of Table I. In addition, a user may introduce a different weighting formula by means of configuration switches as are further described below.

The selector 12 in addition applies an analog signal indicating green color through an A/D converter 22 to a second input of the reduction device 21, and an analog signal indicating blue color through an A/D converter 23 to one input of an eight bit blue color frame buffer 24 and to a third input of the reduction device 21. The output of the reduction device 21 is connected to one input of an eight bit green color frame buffer 25. When processing monochrome video, the video signal is routed through the converter 22 to the device 21, the output of which is written to the buffer 25.

The frame buffers 20, 24, and 25 each store a frame of video for a primary color. While each frame buffer is eight bits wide, they vary in length depending upon the video format being processed. When monochrome applications are being performed, the red color buffer 20 and the blue color buffer 24 can be un-plugged to reduce the cost of the system.

The analog-to-digital converters 19, 22, and 23 respectively digitize the analog red, green and blue video signals to form eight bit digital signals. The red and blue digital signals are output respectively to the frame buffers 20 and 24, while the green digital signal is subjected to a color to monochrome reduction by the device 21 before being sent to the frame buffer 25.

The sync detector 13 and sync separator 14 also receive the composite video signal from the plug-in video input connector 10. The sync detector detects sync signal parameters such as sync voltage level, sync width, number of serrations, and pulse width to lock onto a video sync signal.

The sync separator 14 separates out the video vertical and horizontal sync signals from the composite video sync signal received from the connector 10.

The sync detector 13 also receives information such as sync voltage level, sync width, and number and width of serrations from the sync separator 14, which in turn has received all sync separation/detection information from the system microprocessor 36. When the detector 13 is locked onto a sync signal, the detector informs the sync separator 14 by way of line 26. The video input connector 10 then routes the synchronization signals (whether composite or separate) to the separator 14, which separates the vertical and horizontal sync signals from the incoming video signal. Further, the connector routes a digital code by way of line 10*a* to the microprocessor 36 to identify the type of the video signal being received. In response thereto, the microprocessor supplies the separator 14 with timing parameters such as horizontal and vertical sync timing, polarities, and pulse widths. The separator 14 thereupon extracts the horizontal and vertical sync signals from the video signal. A vertical sync signal at a first output of the separator 14 is applied to a first input of a frame buffer input control unit 27, to a first input of a pixel clock generator 28, and to a first input of a flat panel timing generator 29. A horizontal synchronization signal at a second output of the sync separator 14 is applied to a second input of the generator 28, to a second input of the generator 29, and to a second input of the control unit 27. The output of the generator 28 in turn is connected to a third input of the control unit 27, and to a third input of the generator 29. The output of the control unit 27 is applied to a clock input of the green frame buffer 25, to a clock input of the blue frame buffer 24, and to a clock input of the red frame buffer 20.

The frame buffer input control unit 27 manages the incoming video to insure correct storage into the frame buffers. As a consequence to a control signal received from the microprocessor 36, the control unit 27 adopts the correct writing sequence to store incoming video signals sequentially, line by line, top to bottom, as either interlaced or non-interlaced signals at the rate received. As will be further described below, however, the frame buffer outputs are independently supplied at the optimum flat panel video rate.

In response to control information received from the microprocessor 36, the pixel clock generator 28 is line locked to each horizontal line of incoming video, and synchronizes all pixel operations for processing video data. The flat panel timing generator 29 comprises counters and timers necessary to generate control timing signals to drive the flat panel display. The generator 29 also creates correct timing signals for fitting an image on the display screen being used, and enables and disables timing signals as the power to the electronic control unit of FIG. 1 is turned on and off.

Continuing with the description of FIG. 1, the output of frame buffer 20 is connected to one input of a plug-in flat panel interface module 30, which also receives inputs from the frame buffers 24 and 25. The module 30 in addition receives four inputs from generator 29, including a display enable signal on line 31, a clock signal on line 32, a vertical sync signal on line 33, and a horizontal sync signal on line 34. The module 30 provides a unique code on line 35 to the microprocessor 36 to establish the specific timing needed for the flat panel display that is being used. The microprocessor has stored therein a complete set of flat panel data and timing parameters for each flat panel interface module plug-in that may be used. More particularly, all flat panel display types including LCD, electroluminescent, gas plasma, FED and other flat panel types may be supported.

For monochrome video to be sent to a monochrome display, the red color frame buffer 20 and the blue color frame buffer 24 may be removed from the system. Monochrome video is received at the A/D converter 22, and passes through the color to monochrome reduction device 21 and the green color frame buffer 25 to the interface module 30. For monochrome video to be displayed on a color screen, the green video signal is applied by way of module 30 to the green, red and blue inputs to the flat panel color display. This allows monochrome video to be displayed as black-and-white on a color display. If color video is to be displayed on a monochrome display, the red, blue and green video signals received by the device 21 must be reduced to monochrome video according to a weighting or color mixing standard such as one of the following set forth in Table I:

TABLE I

| | | | |
|---|---|---|---|
| NTSC Weighting | 5/16 Red | 9/16 Green | 2/16 Blue |
| Equal Weighting | 5/16 Red | 6/16 Green | 5/16 Blue |
| Green Only | 0/16 Red | 16/16 Green | 0/16 Blue |
| User Defined | ?/16 Red | ?/16 Green | ?/16 Blue |

The user also may introduce other weighting formulas by way of the configuration switches 45.

The plug-in flat panel interface module 30 consists of the drive electronics controlling the display screen. A plurality of different plug-in modules exist for different flat panel displays. Thus, as before stated, LCD (color or monochrome), electroluminescent, gas plasma, FED, and other types of flat panel technologies can be supported.

In response to the control code supplied by the module 30 on line 35, the microprocessor 36 issues a programmable control signal on a line 37 to a fourth input of generator 29,and a control signal on a line 38 to one input of an image size/position control unit 39. The control unit 39 provides timing signals on a line 40 to a fifth input of generator 29, and receive a feedback signal from the generator on a line 41.

The microprocessor 36 manages the entire operation of the electronic control system of FIG. 1, and receives all user control signals such as those generated by an on/off switch 44, configuration switches 45, analog controls 46 such as potentiometers, and digital controls 47 such as pushbuttons.

The configuration switches 45 are a bank of 16 DIP switches, each of which is controlled by the user. The configurations implemented by the first 12 of the switches are set forth in Table II below:

TABLE II

| Red Weight | | | | Green Weight | | | | Blue Weight | | | | Weight- |
|---|---|---|---|---|---|---|---|---|---|---|---|---|
| S1 | S2 | S3 | S4 | S5 | S6 | S7 | S8 | S9 | S10 | S11 | S12 | ing |
| off | off | off | off | off | off | off | off | off | off | off | off | 0/16 |
| on | off | off | off | on | off | off | off | on | off | off | off | 1/16 |
| " | " | " | " | " | " | " | " | " | " | " | " | |
| off | off | off | on | off | off | off | on | off | off | off | on | 8/16 |

TABLE II-continued

| Red Weight | | | | Green Weight | | | | Blue Weight | | | | Weight- |
|---|---|---|---|---|---|---|---|---|---|---|---|---|
| S1 | S2 | S3 | S4 | S5 | S6 | S7 | S8 | S9 | S10 | S11 | S12 | ing |
| " | " | " | " | " | " | " | " | " | " | " | " | |
| on | on | on | on | on | on | on | on | on | on | on | on | 16/16 |

Thus, the opening and closing of the switches 1–4 of the DIP switches controls the red color in the video image. Further, the switches 5–8 control the weighting to be given the green color, and switches 9–12 control the weighting of the blue color.

The thirteenth of the 16 DIP switches of configuration switches 45 indicates whether the analog controls 46 or the digital controls 47 are active. Switches 14–16 control the selection of the threshold for detecting synchronization signals by the sync detector 13. Table III below provides the switch configurations for switches 14–16, and the threshold detection levels that are represented.

TABLE III

| S14 | S15 | S16 | Threshold |
|---|---|---|---|
| off | off | off | −0.10 volts |
| on | off | off | −0.15 volts |
| off | on | off | −0.20 volts |
| on | on | off | −0.25 volts |
| off | off | on | −0.30 volts |
| on | off | on | −0.35 volts |
| off | on | on | −0.40 volts |
| on | on | on | −0.45 volts |

The microprocessor 36 reads the configuration switches 45 to control the weighting (or mixing) of the colors by the color to monochrome reduction device 21. The output of device 21 is saved by the Green Frame Buffer 25.

The image size/position control unit 39 controls the relative size and position of the incoming video images on the display screen. In response to signals received from the microprocessor 36, the unit 39 determines the display screen size, sizes the video image up or down to accommodate the display screen, and reprograms the flat panel timing generator 29 to be compatible with the image size as is further explained below in connection with the description of FIG. 8. The image size/position control unit 39 also creates a set of timing clocks and control signals that are provided to a frame buffer output control unit 42, which in turn addresses memory locations in the frame buffers.

The output of the control unit 39 is connected to a first input of frame buffer output control unit 42, which receives sizing, position, and orientation information from microprocessor 36 on line 43. More particularly, the microprocessor instructs the control unit 42 how to use the timing signals supplied by the image size/position control unit 39 on line 71 to supply memory address locations at third inputs of frame buffer 20, frame buffer 24, and frame buffer 25. The order in which data is read out of the frame buffers determines the form in which the image will be presented on the plat panel display screen. A timing signal that controls the reading of data from the frame buffer memory is output by control unit 39 to control unit 42 on line 65. The different possible presentation forms are described in more detail below in connection with the description of FIG. 12.

By way of example, if the control unit 42 reads the frame buffer video data beginning at the last line and then proceeding to the first, the video image will be displayed upside down on the display screen. This form of display is particularly useful with LCD displays that have a vertical viewing angle that is opposite to that of the viewing angle of user. By reversing the order of reading frame buffer rows and columns, a video image may be presented in portrait form. That is, rotated by ninety degrees. Further, by reading the columns from the right-most to the left-most column, the image can be presented in mirror-image form. A mirror-image resentation is especially useful in overhead projection viewing, and in other applications where the image is first viewed by the user as a reflection in a mirror as with television teleprompters.

In addition to controlling the reading of video data out of the frame buffers to achieve the above video presentations, the control unit 42 also addresses the frame buffer memory locations in a manner to up-size or down-size an image on the display screen. For example, in order to stretch or zoom an image horizontally, the control unit 42 will repeat a column address as often as required to achieve the desired horizontal stretching. In the case of vertical stretching or zooming, a row address is repeated in like manner.

The up and down sizing is independent of whether the image output is being presented "normally", upside-down, mirrored, in portrait form (left or right), or in any other presentation form.

Under the control of the microprocessor 36 and the image size/position control unit 39, the control unit 42 also positions an image on the flat panel display screen by addressing the frame buffer memory locations commencing at any location in the memory space. By changing the starting address of the video to be read, the image can be positioned left-to-right, right-to-left, or up or down.

In view of the above, it is seen that a user has complete control over image presentation on a display screen.

In addition, the microprocessor 36 accesses application software stored in memory unit 48 to process video signals for display on the flat panel display screen (not shown). The microprocessor also applies a programming signal on a line 49 leading to a third input of sync separator 14, a programming signal on a line 50 leading to a third input of generator 28, and a selector signal on a line 51 leading to both a sixth input of selector 12 and a fourth input of the reduction device 21. The microprocessor further supplies a timing signal to control unit 27 on a line 52, and a control signal to power control circuits 53 on a line 54. Further, the microprocessor receives video format information on a line 60 leading from the sync separator 14.

The power circuits 53 supply operating voltages to all of the subsystems of the electronic control system of FIG. 1. The circuits are comprised of voltage switches which are controlled by the microprocessor 36. As these circuits standing alone are well known and within the general knowledge of the industry, only those connections necessary for the flat panel display, the backlight inverter power supply 58, and the power indicator 61 are shown.

Other tasks provided by the microprocessor 36 include automatic video format selection for each plug-in video input connector 10 that is installed. By way of example only, when a connector 10 for VGA type video is installed, the microprocessor 36 measures the polarity and timing of the horizontal and vertical sync signals to determine the video mode being received. The microprocessor thereupon programs the number of lines and columns of video to be received into the pixel clock generator 28 and the frame buffer input control unit 27. In addition, the microprocessor programs the video row/column format into the image size/position control unit 39 to correctly size and center the video image on the display screen.

The video modes that are detected by the microprocessor include but are not limited to the following as listed in Table IV below:

TABLE IV

| VSYNC | HSYNC | VSYNC POLARITY | HYSYNC POLARITY | MODE |
|---|---|---|---|---|
| 60/sec. | 449 | Positive | Negative | 80 x 25 Text |
| 60/sec. | 449 | Positive | Negative | 40 x 25 Text |
| 60/sec. | 449 | Negative | Positive | 640 x 350 Graphics |
| 60/sec. | 525 | Negative | Negative | 640 x 480 Graphics |
| 56/sec. | 625 | Negative | Negative | 800 x 600 Graphics |
| 60/sec. | 625 | Negative | Negative | 800 x 600 Graphics |

For composite video, the microprocessor 36 reads horizontal lines and vertical rates to determine the video mode. The modes shown in the following Table V are typical but not exclusive, and may be interlaced or non-interlaced:

TABLE V

| VSYNC | HSYNC | MODE |
|---|---|---|
| 60/sec. | 262 or 263 | NTSC Interlaced |
| 60/sec. | 312 or 313 | PAL Interlaced |
| 100/sec. | 562 or 563 | HDTV Interlaced |
| 60/sec. | 524 | NTSC Non-Interlaced |
| 60/sec. | 624 | PAL Non-Interlaced |
| 60/sec. | 472 or 473 | 945 LSR Interlaced |

The microprocessor 36 also works in cooperation with the A/D converters 19, 22, and 23 to accommodate high rate video signals in the range of 25 to 40 MHz. More particularly, since high speed converters are very expensive, the electronic control system employs two A/D converters per color. The microprocessor recognizes that the incoming video is very fast, and causes the pixel clock generator 28 to produce two synchronous clocks per color for each A/D converter pair. One A/D converter for each color digitizes the odd pixels, and the other converter digitizes the even pixels. In this manner, the individual A/D converters only have to be able to handle one-half of the incoming video rate. Thereafter, the frame buffer input control unit 27 intermeshes the odd and even pixels for storage in the frame buffers 20, 24, and 25.

Other tasks performed by the microprocessor 36 in controlling the pixel clock generator 28 include programming a phase locked loop of the generator that is synchronized to the video horizontal sync signal. The phase lock loop contains a high frequency oscillator which will output a clock signal when the microprocessor detects a match between the horizontal sync signal, and a microprocessor feedback signal having a frequency in number of clock pulses per horizontal sync. For example, if there are 800 columns (or clocks) required for a video format, the microprocessor will program the feedback to the phase lock loop to be 800 clocks. In response thereto, the phase locked loop will produce a pixel clock that occurs 800 times per horizontal sync and that is synchronized to the horizontal sync signal. The pixel clock is used to synchronize all input timing to the electronic control system of FIG. 1.

One of the unique features of the electronic control system of FIG. 1 is the function of the various power systems. For example, the microprocessor 36 senses the on/off switch 44. If an "on" state is detected at power start-up, the switch thereafter is ignored. If the switch 44 is in the "off" state at power start-up, the switch thereafter will be sensed regularly and may act as an on/off switch. Further, the electronic control system will not power up unless incoming video is present as indicated by the occurrence of sync signals on line 60. If the system is on and running, and the video signal is removed, the system will power down regardless of the state of the on/off switch 44. Thus, automatic power up and power down sequencing for the electronic control system is provided as video signals are received and removed. Lastly, as a power management feature, the microprocessor 36 provides power sequencing for both the control system and the flat panel display being driven. The sequencing is accomplished by causing the flat panel timing generator 29 to enable and disable timing signals as the power to the control system is turned on and off.

The power control circuits 53 supply a system power control signal on a line 55 leading to an input of plug-in flat panel interface module 30, a display power control signal on a line 56 leading to a power indicator 61, and a backlight power control signal on a line 57 leading to an input of a backlight inverter power supply 58. The output of the power supply 58 is applied to a line 59 to energize backlight tubes providing background lighting.

More specifically, the power control circuits 53 supply power throughout the electronic control system of FIG. 1, and have a capability to power-down if no video signal has been received by the video input connector 10. The backlight inverter power supply 58 converts system DC voltages to high-voltage, low current AC power to drive the fluorescent tubes in liquid crystal displays, and includes different backlight inverters to drive single tube, dual tube, four tube, and other LCD displays. The output voltage of the power supply 58 can be varied to provide a backlight brightness/dimness feature.

Lastly, a diagnostic port 62 is connected by way of a line 63 to an I/O port of the microprocessor 36 to allow diagnostic information to be supplied during operation of the electronic control system.

In operation, the microprocessor 36 controls all functions in the electronic control system of FIG. 1. By way of example, the microprocessor manages the power operation of the electronic control system, identifies the modes of the incoming video (interlace, non-interlace, resolution, type), measures the video signal timing parameters, controls the image size, position, orientation, focus and contrast, controls the timing of the electronic control system and flat panel display, controls backlight intensity, and controls color/monochrome transition processes.

The plug-in video input connector 10 provides a four bit binary code to the microprocessor 36 on line 10*a*. The code informs the microprocessor of the type of video that will be recieved as further described in Table VI below:

TABLE VI

| CODE | VIDEO TYPE |
|---|---|
| 0 | VGA With Separate HSYNC And VSYNC |
| 1 | RS-170/RS-343 RGB Sync-On-Green |
| 2 | RS-170/RS-343 RGB Separate Composite Sync |
| 3 | Composite Video (NTSC/PAL) |
| 4 | Computer Video (HDTV) |
| 5–15 | Future Expansion |

Upon determining video from the code, the microprocessor 36 determines video format or mode. For example, if composite video is being received, the microprocessor will determine whether the video is NTSC, PAL, SECAM, XGA, VGA, SVGA or other RGB mode.

In determining video formats,the microprocessor 36 measures the number of vertical syn (VSYNC) signals and horizontal sync (HSYNC) signals issued by the sync separator 14, and detects video formats on the basis of the number of horizontal syncs that are detected for each vertical sync signal detected, and the polarity of the VSYNC and HSYNC signal as follows:

TABLE VII

| FORMAT | HSYNC/VSYNC | HSYNC POLARITY | VSYNC POLARITY |
|---|---|---|---|
| NTSC | 262 or 263 | | |
| PAL | 312 or 313 | | |
| HDTV | 562 or 563 | | |
| VGA 640 x 480 Graphics | | – | – |
| VGA 80 x 25 Text | | – | + |
| VGA 640 x 350 Graphics | | + | – |

The microprocessor also receives an eight bit code from the flat panel interface module 30 to determine the type of flat panel display being used, whether LCD, electroluminescent, gas plasma, FED or other type. Up to 256 different flat panel types can be distinguished with the eight bit code. An example of typical codes with manufacturer and model number designations is set forth in Table VIII below. The accompanying parameters are provided by the flat panel display manufacturers.

TABLE VIII

| FLAT PANEL CODE | MANUFACTURER/ MODEL NO. | PARAMETERS |
|---|---|---|
| 00 | Sharp 640 x 480 | rows = 480<br>columns = 640<br>max clock = 25 MHz<br>image start column = 44<br>image start rows = 34 |
| 01 | Sharp 800 x 600 | rows = 600<br>columns = 800<br>max clock = 40 MHz<br>image start columns = 88<br>image start rows = 23 |
| 02 | NEC 640 x 480 | rows = 480<br>columns = 640<br>max clock = 25 MHz<br>image start column = 48<br>image start row = 23 |
| 03 | NEC 800 x 600 | rows = 600<br>columns = 800<br>max clock = 40 MHz<br>image start columns = 128<br>image start rows = 21 |

Upon receiving the code, the microprocessor informs the flat panel timing generator 29 which of the entries in Tables VI and VII that are to be used by the generator, and controls the operation of the sync detector 13 and sync separator 14 in extracting synchronization signals from the incoming video signal.

The synchronization signals supplied by the sync separator 14 are used by the pixel clock generator 28 to generate a synchronous pixel clock signal, and are used by the microprocessor along with the pixel clock signal to synchronize the A/D converters 19, 22, 23. In response, the A/D converts sample and digitize the video signals supplied by the video input selector 12. The pixel clock and the synchronization signals also are used by the frame buffer input control unit 27, under control of the microprocessor 36, to store data into the frame buffers 20, 24, and 25. If the incoming video is interlaced, the input control unit 27 will de-interlace the video as it is stored into the frame buffers.

If the microprocessor 36 fails to receive synchronization signals from the sync separator 14 by way of line 60, the microprocessor will power down the system in accordance with the power down rules of the particular flat panel display that is being used. The microprocessor may contain a power up/down table of rules for each flat panel display type that is used.

Upon reading the flat panel interface module 30 code on line 35 to determine flat panel type, size and resolution, the microprocessor controls the timing generator 29 and image size/position control unit 39 to upsize or down size an image for a correct fit on the display screen. By use of the configuration switches 45, the user also may instruct the microprocessor to alter the sizing process to zoom or shrink the image, change the position and orientation of the image on the screen, change the image contrast, and change the display brightness.

As will become evident from the further disclosures below, the electronic control system of FIG. 1 is a versatile system which may adapt to any format, and which is able to accommodate video resolutions up to at least 2048×2048 (rows×columns).

The electronic control system of FIG. 1 is comprised of both off-the-shelf commercial devices and customized devices. The off-the-shelf devices are identified in Table IX below:

TABLE IX

| Name/ Reference Number | Manufacturer | Part Number | Manufacturer's Address |
|---|---|---|---|
| Microprocessor 36 | Philips Semiconductors | P80CL580HFD | 811 East Argus Ave. Sunnyvale, California 94088 |
| Sync Detector 13 & Sync Separator 14 | Brooktree Corporation | BT261 | 9950 Barnes Canyon Road San Diego, California 92121 |
| Composite Video To RGB Converter 11 | Brooktree Corporation | BT254 | 9950 Barnes Canyon Road San Diego, California 92121 |
| Pixel Clock Generator 28 | Integrated Circuit Systems, Inc. | ICS1522 or AV9173 | 2435 Boulevard Of The Generals PO Box 968 Valley Forge, Pennsylvania 19482 |
| A/D Converters 19, 22, 23 | Signal Processing Technologies, Inc. | SPT1175BCS | 4755 Forge Road Colorado Springs, Colorado 80907 |
| Non-Volatile RAM memory 66 | Xicor Inc. | X24C44 | 851 Buckeye Court Milpitas, California 95035 |

Figure 2A:
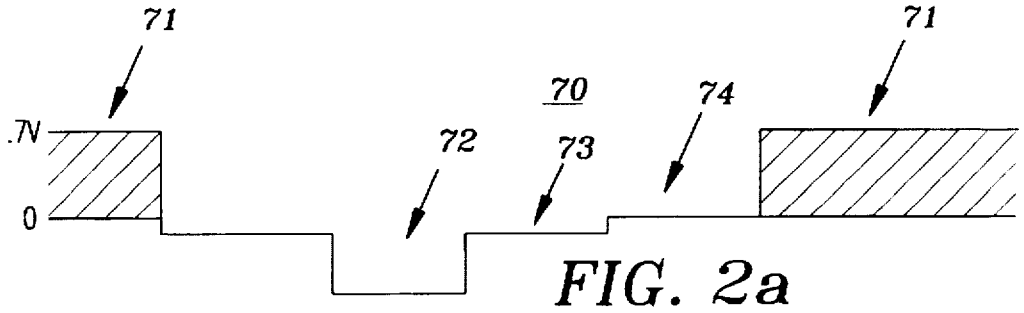
FIGS. 2*a* and 2*b* are a timing diagrams graphically illustrating the horizontal and vertical time syncs which have been separated from a video signal received by the electronic control system of FIG. 1.
Figure 2B:
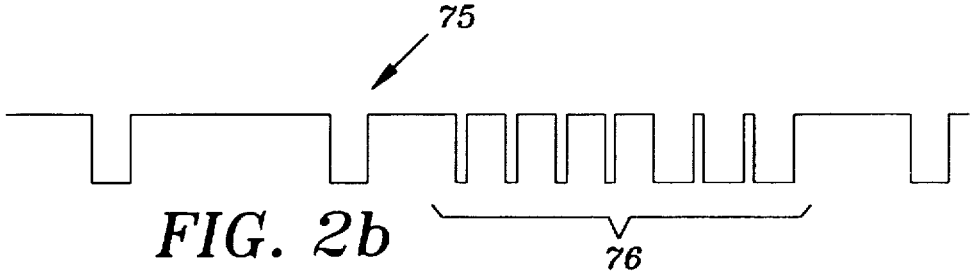

Referring to FIGS. 2*a* and 2*b*, a composite synchronization signal 70, consisting of both sync and video image signals, may appear with video formats such as the NTSC (National Television Standards Committee) and PAL (Phase Alternating Line) formats. In the composite signal, the video image content is represented by the cross-hatched areas 71, which may vary from 0 volts to 1.0 volts. A negative voltage component 72 of this video signal is the horizontal synchronization signal, which may vary to as much as −0.5 volts. When a number of these negative pulses occur that have different pulse durations as illustrated in waveform 75, a vertical synchronization signal is indicated.

As before stated, the sync separator 14 extracts the horizontal sync and vertical sync signals from the video signal, and provides the sync signals at voltage levels compatible with the electronic control system of FIG. 1. Further, the sync separator is programmed by the microprocessor 36 to detect the occurrence of a specific number of serration and equalization pulses 76 in waveform 75 of FIG. 2*b*, and thereby determine the vertical sync period. Although the timing profile for a composite video signal may vary from video format to video format, the electronic control system accommodates all such formats.

The composite video to RGB converter 11 of FIG. 1 extracts the picture content of the incoming video signal. Returning to FIG. 2*a*, the microprocessor 36, after determining the video mode as above described, detects the occurrence of the black level reference period or pedestal 74 of the waveform 70, and programs the converter 11 by way of a line 67 to read the pedestal 74 to set a voltage level for the color black.

By way of summary, the sync separator 14 removes the negative polarity synchronization component of the video signal of waveform 70, and produces separated sync signals. The composite video to RGB converter 11 extracts the image content of the waveform 70, and produces separated red, green, and blue signals. The red, green, and blue signals then are fed to the A/D converters 19, 22, and 23.

Figure 3A:
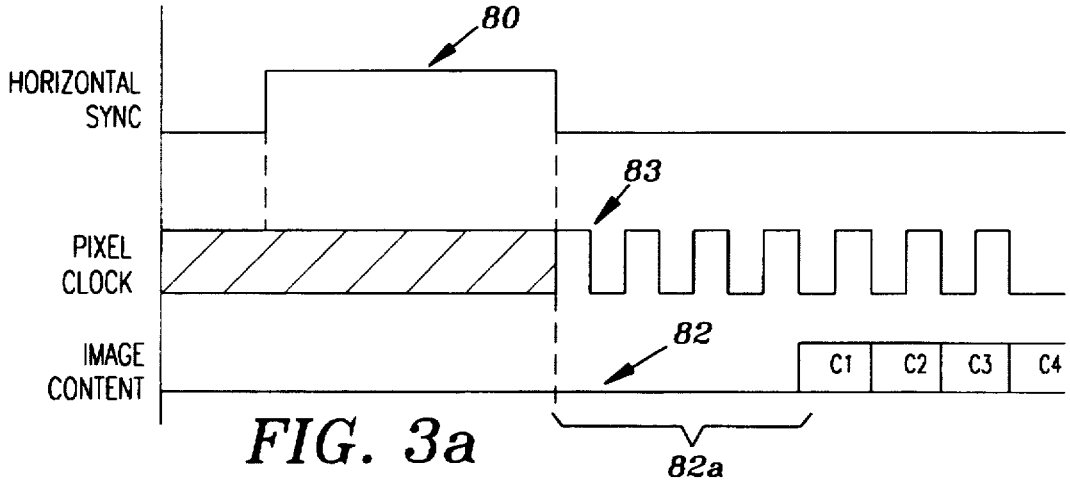
FIGS. 3*a* and 3*b* illustrate graphically the generation of a pixel clock from the separated vertical and horizontal time syncs of FIG. 2.
Figure 3B:
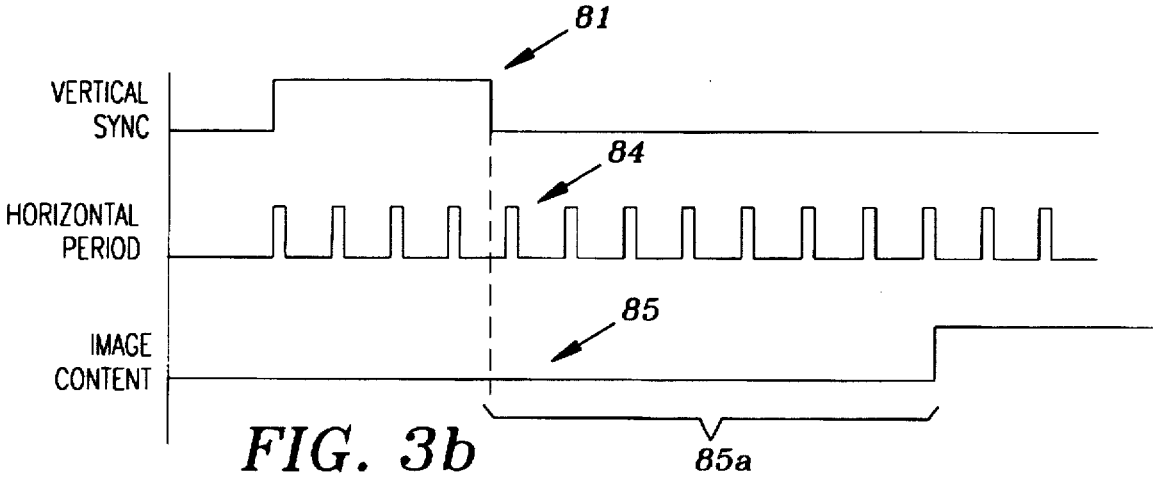

FIG. 3*a* and 3*b* illustrate more clearly the timing relationship among a separated horizontal sync signal 80, a separated vertical sync signal 81, a video signal 82, and a pixel clock signal 83. The vertical sync signal 81 indicates that the next horizontal sync pulse 80 is at the beginning of a video image. Further, the pixel clock generator 28 of FIG. 1 generates a pixel clock signal 83 that is synchronized to the horizontal sync signal 80.

As shown by a comparison of signals 82 and 83, a number of pixel clocks occur between the trailing end of a horizontal sync pulse and the appearance of a video image. The time period during which these pixel clocks occur is referred to as the horizontal retrace period 82*a*. Further, a comparison of a horizontal sync signal 84 and a video image signal 85 in a more compressed time frame indicates that a number of horizontal sync pulses occur after the trailing edge of a vertical sync pulse, and before a video image signal appears. These horizontal sync pulses define a vertical retrace period 85*a*.

Figure 4:
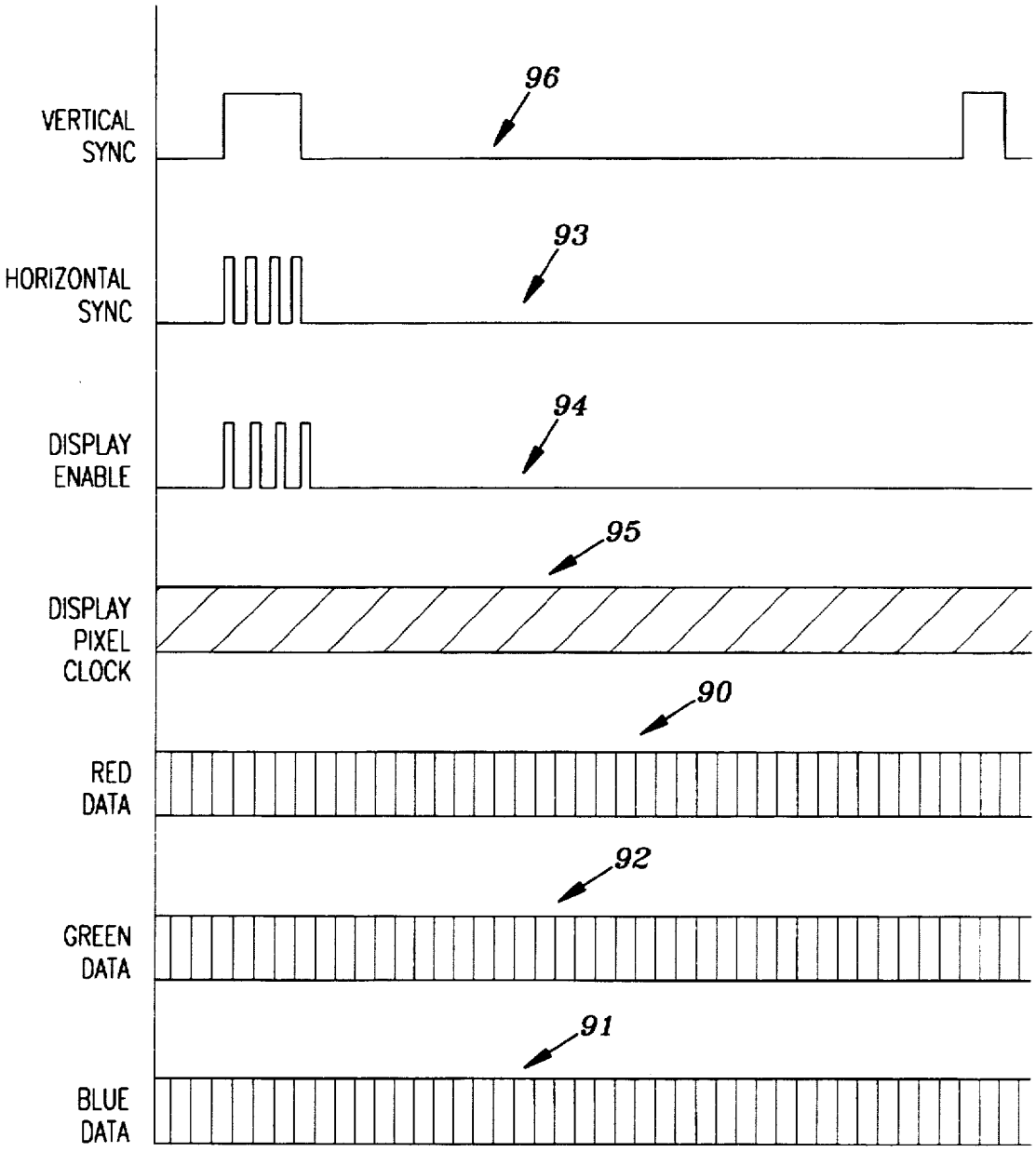
FIG. 4 illustrates graphically the data and timing signals which are generated by flat panel timing generator 29 and supplied to the plug-in flat panel interface module 30 of FIG. 1 to drive a flat panel display.

FIG. 4 illustrates graphically the electronic signals which are applied by the electronics control system of FIG. 1 to the Plug-In Flat Panel Interface Module 30. More particularly, the digital signals 90, 91 and 92 respectively are supplied by buffers 20, 24 and 25 of FIG. 1. Further, the waveforms 93, 94, 95 and 96 of FIG. 4 are supplied by the flat panel timing generator 29 respectively to lines 34, 31, 32 and 33 of FIG. 1 leading to inputs of the module 30.

FIGS. 5*a*–5*h* collectively comprise a logic flow diagram of the operation of the microprocessor 36. When power is applied to the system, the microprocessor begins executing instructions at logic step 100 to initialize the microprocessor itself and program the electronic control system of FIG. 1 to a known state. More particularly, at logic step 101, the pixel clock generator 28 is programmed to assume a 640 column video signal, the counters of the frame buffer input control unit 27 and the frame buffer output control unit 42 are set to zero, and the image size/position control unit 39 is programmed to accommodate a 1-to-1 sized image positioned in the upper left image corner at row 0 and column 0. The logic flow process next proceeds to logic step 102 where the plug-in flat panel interface module 30 is read to retrieve a code identifying the type of flat panel display which has been plugged into the system. Thereafter, at logic step 103, the configuration switches 45, analog controls 46 and digital controls 47 are read to implement user hand-set commands such as color to monochrome reduction, image expansion/reduction, image contrast change, orientation of image change on the display screen, position of image change on the screen, and backlight brightness adjustment. The information read from the configuration switches 45, analog controls 46, and digital controls 47 are stored in the non-volatile RAM memory 66 of FIG. 1.

Figure 5A:
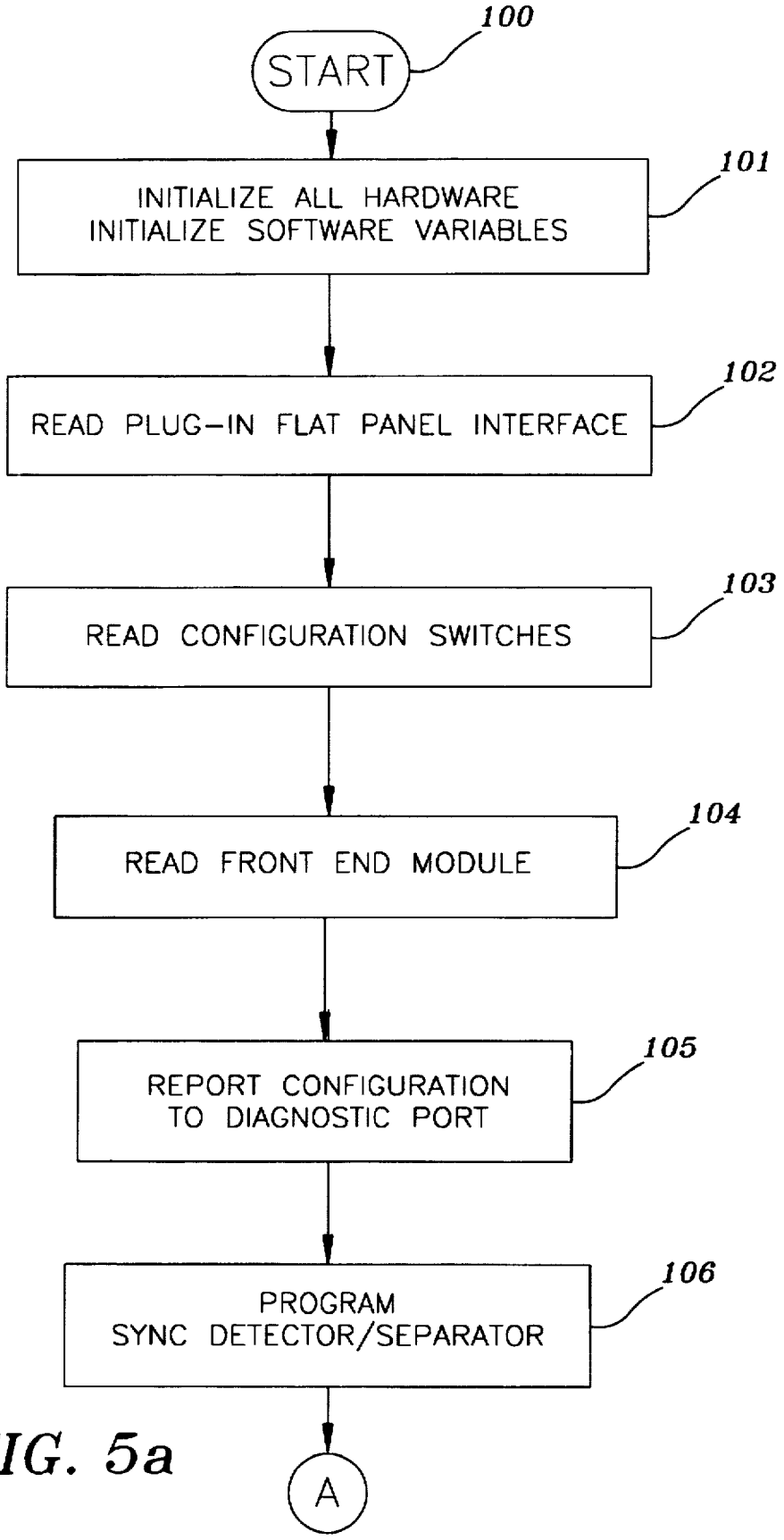
FIGS. 5*a*–5*h* are logic flow diagrams of the operation of the microprocessor 36 of FIG. 1.

From logic step 103 of FIG. 5*a*, the logic flow process proceeds to logic step 104 where a code is supplied by the video input connector 10 on line 10*a* to indicate the type of video signal which has been received. Thereafter, at logic step 105, all of the parameters read by the microprocessor are supplied to the diagnostic port 62, which is an RS-232 communications port that resides on the microprocessor. As a result, it may be verified that the microprocessor is operating in the correct state for the options and configurations that have been selected by the user.

At logic step 106, the sync detector 13 and sync separator 14 are programmed by way of lines 49 and 26 to allow a video signal to be received. Even though the initial programming of the sync detector 13 and sync separator 14 may be incorrect, the microprocessor counts the synchronization signals as before described and updates the detector 13 and separator 14 accordingly.

Figure 5B:
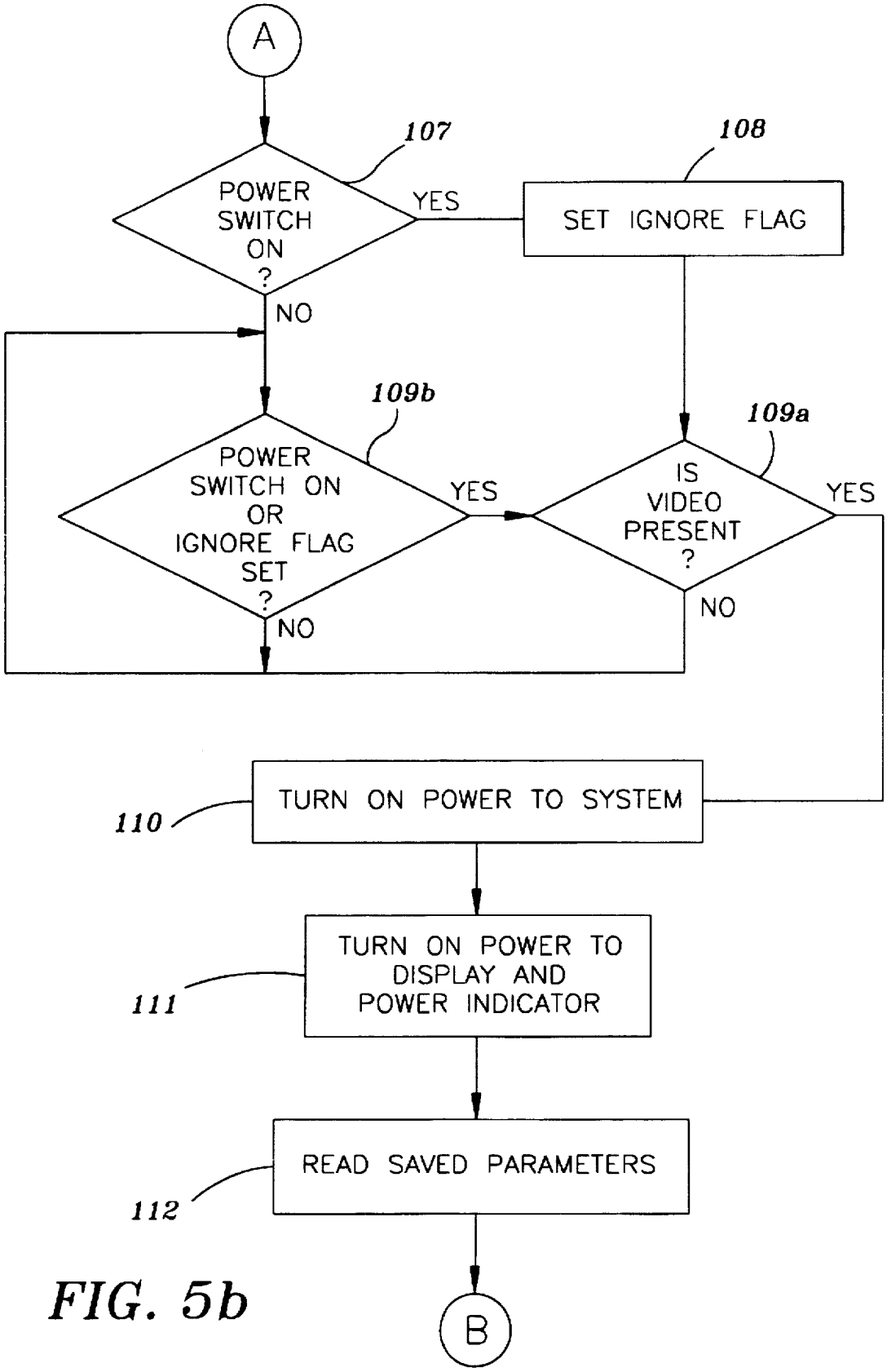

The logic flow process next senses the on/off switch 44 at logic step 107 of FIG. 5*b* to determine whether the switch has been depressed. If yes, the logic flow process first proceeds to logic step 108 to set a flag to thereafter ignore the switch, and then branches to logic step 109*a* where the sync separator 14 is sensed on line 60 to determine whether a video signal is present. If not, the logic flow process proceeds to logic step 109*b* to again determine whether the on/off switch 44 has been depressed or a flag to ignore the switch has been raised. If either event has occurred, the logic flow process proceeds from logic step 109*b* to logic step 109*a*. If neither event has occurred, the logic flow process cycles back to the input of logic step 109*b* until either the on/off switch 44 is depressed or an ignore flag is raised.

When it is determined at logic step 107 that the on/off switch 44 has been depressed, the logic flow process proceeds from logic step 107 to logic step 109*b* where the logic flow process continues as before described. If a video signal is detected at logic step 109*a*, the logic flow proceeds to logic step 110 where DC power is applied to the electronic control system hardware (other than the microprocessor) and the system enters an on-state. Thereafter, at logic step 111, the microprocessor follows an internally stored power-up timing sequence for the particular flat panel display which has been connected. The microprocessor steps are as follows in the order given: first energize the power control circuits 53 to power up the flat panel display by way of line 55, then apply the synchronization signal outputs of sync separator 14 by way of the flat panel timing generator 29 to the flat panel interface module 30, next apply the outputs of frame buffers 20, 24, and 25 to the flat panel interface module 30, then cause the power control circuits 53 to energize the backlight inverter power supply 58. After the power sequence is complete, the microprocessor causes the power control circuits 53 to energize an LED power indicator 61 as described in connection with the description of FIG. 11 below.

From logic step 111, the logic flow process proceeds to logic step 112 where microprocessor 36 retrieves display screen parameters such as image brightness, sizing, contrast, orientation, and position as previously stored in the non-volatile RAM 66 at logic step 103.

Figure 5C:
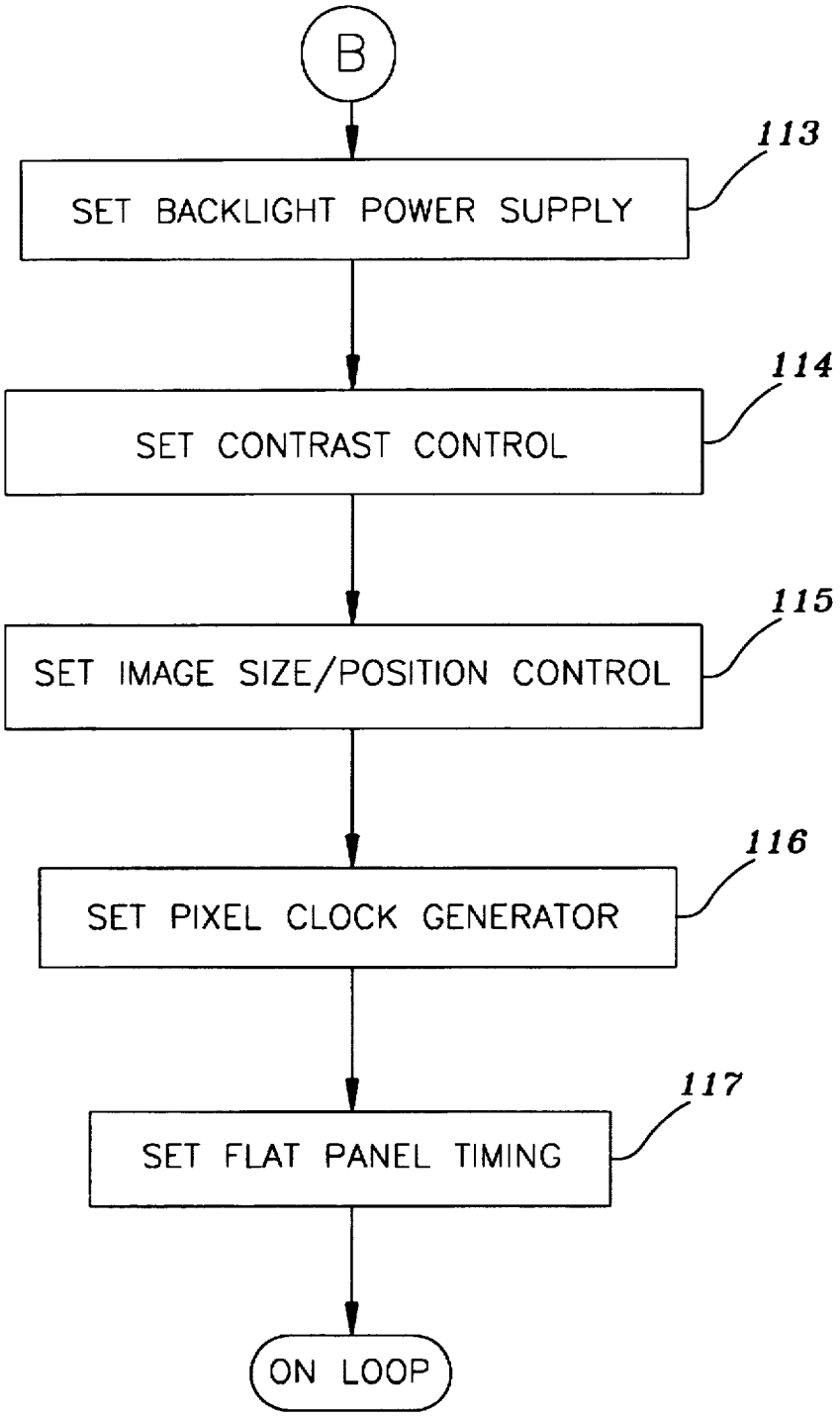

At logic step 113 of FIG. 5*c*, the microprocessor writes an eight bit value to a D/A converter comprising the power control circuits 53 of FIG. 1. The converter provides a brightness control voltage to the backlight inverter power supply 58. This value is stored in the non-volatile RAM memory when power is turned off, and retrieved to reestablish the backlight brightness when power is restored. From logic step 113, the logic flow process proceeds to logic step 114 where the microprocessor writes an eight bit data value by way of line 51 into the video input selector 12. The value represents the upper digitizing voltage level for the A/D converters 19, 22, and 23. The A/D converters in turn have a programmable voltage reference that can be adjusted, by way of example only, from 0.5 volts to 1.0 volts by the microprocessor to set the image contrast and allow low amplitude video signals to be digitized as if they were at full amplitude.

The logic flow process next proceeds to logic step 115 where a command is issued to set the stored image size and position parameters into the image size/position control unit 39 by way of line 38. The parameter codes and representations are set forth in Table X below:

TABLE X

| Code | Representation | Range | Description |
|---|---|---|---|
| 0 | Upper Left Column Image Start Position | 0000 to 2047 | Upper Left Column Position For Image Start |
| 1 | Upper Left Row Image Start Position | 0000 to 2047 | Upper Left Row Position For Image Start |
| 2 | Column Replicate Factor | X:Y | Where X Is The Column Repeat Number. Y Is The Column Replicate Number. * |
| 3 | Row Replicate Factor | X:Y | Where X Is The Row Repeat Number. Y Is The Row Replicate Number. * |

The rows in the above table marked with an asterisk are further explained by the following example. Where X=2 and Y=1, every row and column is repeated. Where X=1 and Y=5, every fifth row and column is repeated. Further, when X=2 and Y=10, every row and column is repeated, and every tenth row and column is repeated again.

From logic step 115 the logic flow process proceeds to logic step 116, where the microprocessor 36 writes into the pixel clock generator 28 the number of pixel clocks per horizontal line that are sensed from the outputs of sync separator 14. The logic flow process proceeds next to logic step 117 where the microprocessor writes eight bit values corresponding to each of the following into the flat panel timing generator 29 by way of line 37: output pixel clock frequency, number of columns for the specific flat panel display used, number of rows for the flat panel display, pulse width of the vertical sync pulse, and pulse width of the horizontal sync pulse.

Figure 5D:
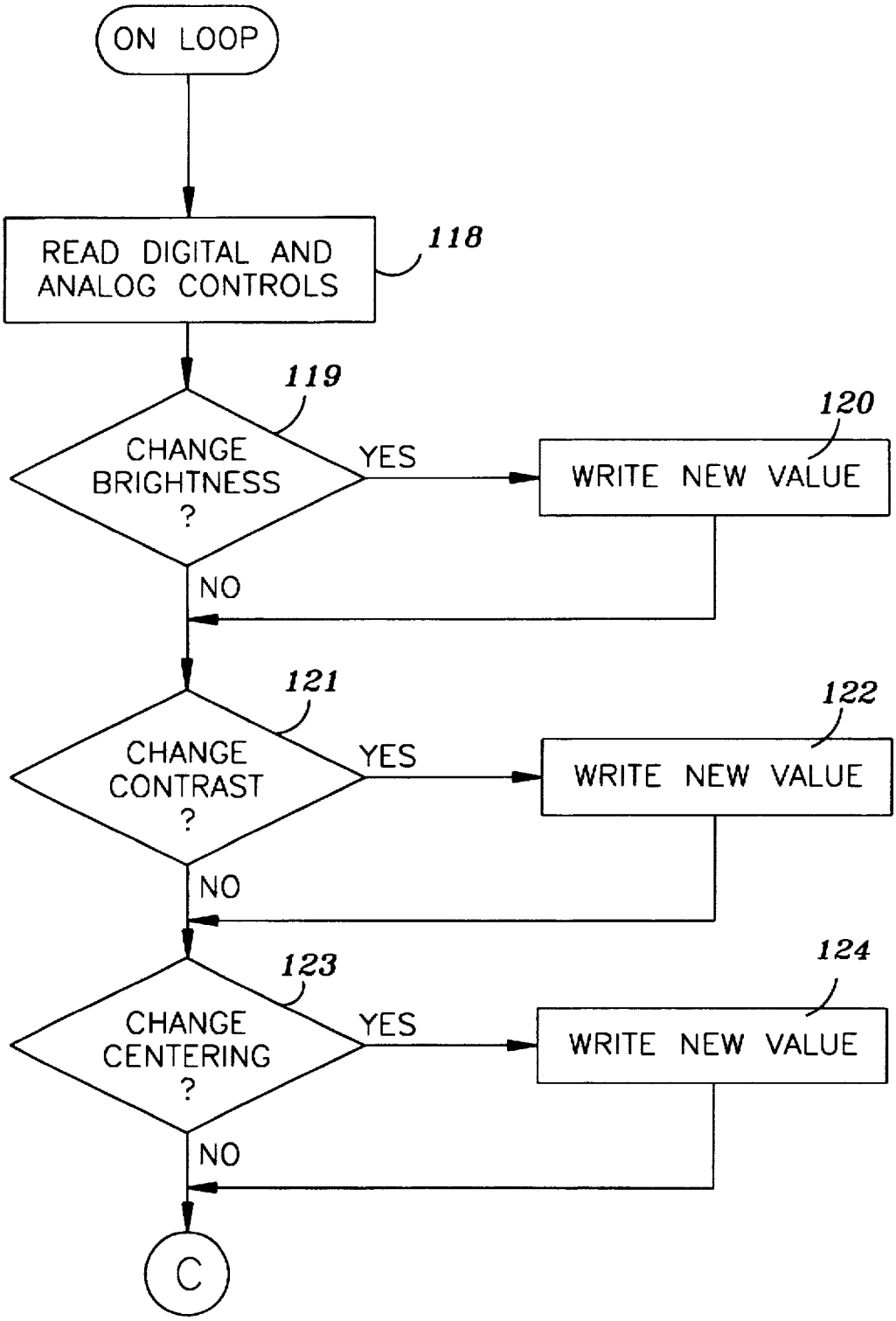

At this point the system is operating with all initial values for the incoming video signal that have been detected by the electronic control system of FIG. 1, and the logic flow process enters an on-loop state at logic step 118 of FIG. 5*d* where the analog controls 46 and digital controls 47 are again sampled. The analog controls may be potentiometers connected by an A/D converter on the microprocessor 36, and the digital controls may be register bits corresponding to push button switch closures. At logic step 119 the data which was acquired at logic step 118 is compared to data previously read to determine whether a change in brightness command has occurred. If a change has occurred, then at logic step 120 the new value is saved by the microprocessor 36 for future comparison, and supplied by the microprocessor through a D/A converter (internal to the power control circuits 53 of FIG. 1) to the input of the backlight inverter power supply 58. Thereafter, the logic flow process proceeds to logic step 121 of Figure 5*d*.

If no change in the brightness control is detected at logic step 119, the logic flow process proceeds from logic step 119 to logic step 121 where the data acquired in logic step 118 is compared against previously read data to determine whether a change in image contrast has been commanded. If a match occurs at logic step 121, the logic flow process proceeds to logic step 122 where the microprocessor stores the new contrast value internally for future reference, and issues the new contrast value by way of line 64 to the programmable voltage reference of A/D converters 19, 22, and 23. If no change in the contrast control has been detected, the logic flow process proceeds from logic step 121 to logic step 123 to test for a change in image centering position. If a change is detected, the logic flow process proceeds to logic step 124 to write new timing parameters into the flat panel timing generator 29 by way of line 37, and new centering parameters into the image size/position control unit 39 by way of line 38. Thereafter, the logic flow process proceeds to logic step 125 of Figure 5*e*.

Figure 5E:
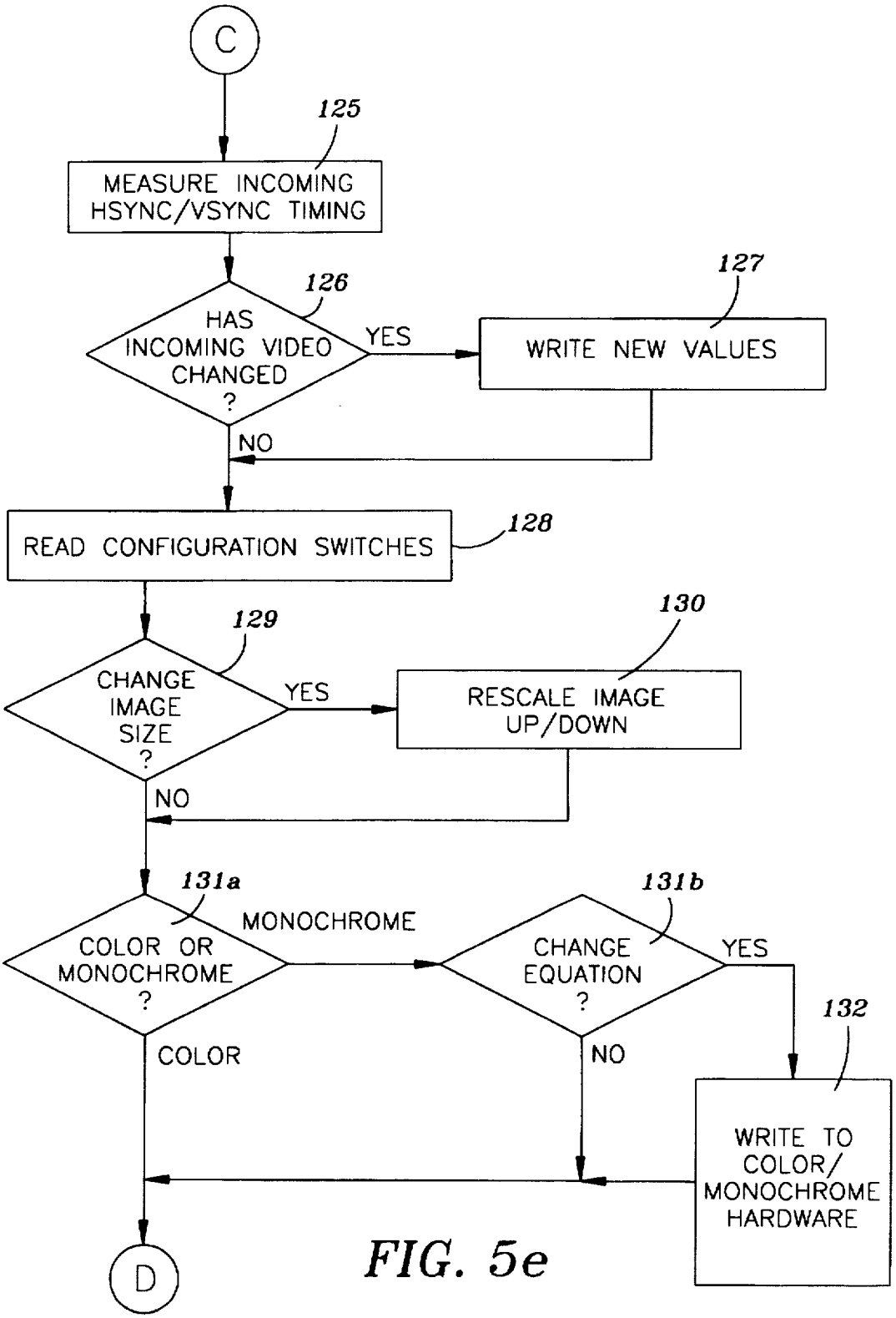
Figure 5F:
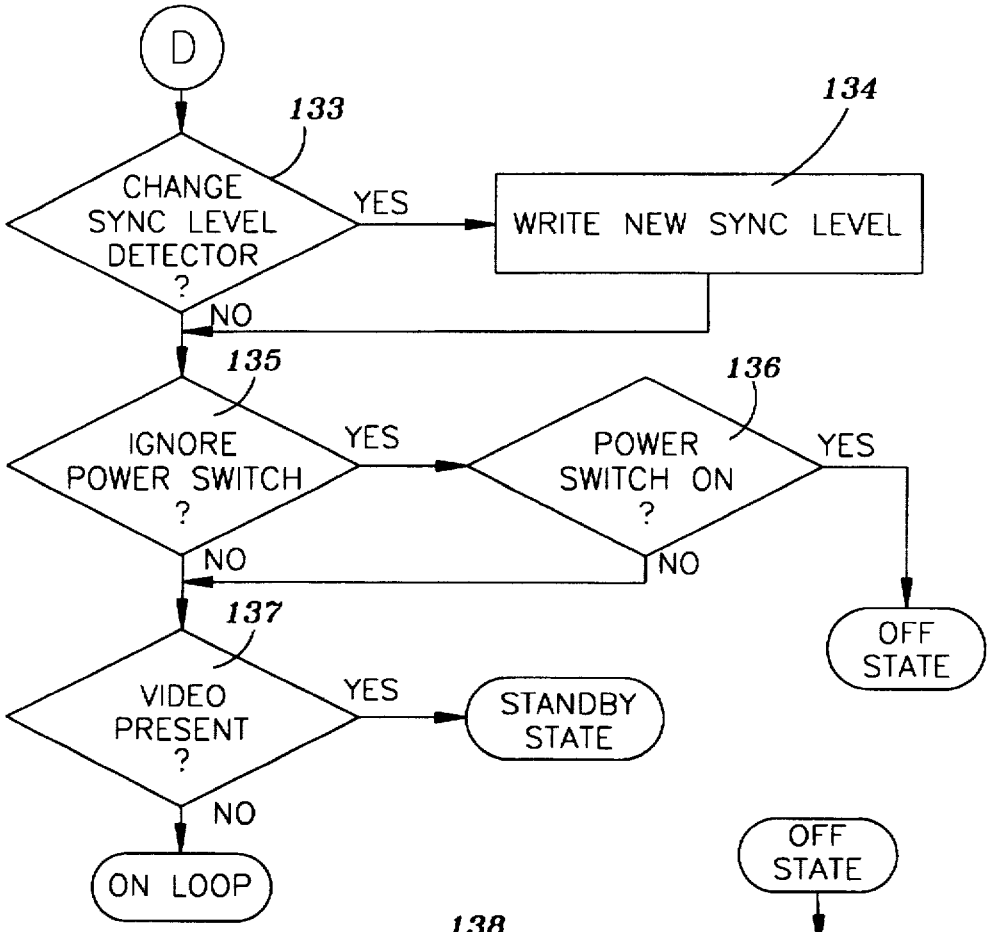

If no change in the image centering control is detected at logic step 123 of Figure 5*d*, the logic flow process proceeds directly to logic step 125 of FIG. 5*e*, where the microprocessor senses the sync signal outputs of sync separator 14. The number of vertical sync pulses that occur in a second, and the number of horizontal sync pulses that occur per vertical sync are measured. More particularly, the sync signal outputs of sync separator 14 are fed to time base interrupt inputs of the microprocessor. The time base interrupts are set to occur every 10 ms. Every time a vertical sync occurs, a vertical sync counter internal to the microprocessor increments by one. After ten interrupts are counted, the vertical sync counter contents are saved as the vertical sync rate. A horizontal sync counter also is used which is incremented on the occurrence of horizontal sync pulses. The microprocessor resets the horizontal sync counter on the occurrence of a vertical sync pulse, and saves the contents of the counter upon the occurrence of the next vertical sync pulse. The contents correspond to the number of horizontal lines in a video signal.

At logic step 126, the microprocessor compares previously sampled values of the number of horizontal lines and the vertical rate with currently measured values. If a change is detected, the logic flow process proceeds to logic step 127 where the microprocessor performs a table look up of timing parameters stored in its memory as depicted in Table XI below:

TABLE XI

| VIDEO FORMAT | SYNC SEPARATOR/ SYNC DETECTOR | PARAMETERS |
|---|---|---|
| Composite NTSC | Brooktree BT261 | Clock = 12.2727 MHz<br>HSYNC = 779 clocks<br>VSYNC = 525 HSYNCs<br>Interlaced |
| Composite PAL | Brooktree BT261 | Clock = 14.75 MHz<br>HSYNC = 943 clocks<br>VSYNC = 625 HSYNCs<br>Interlaced |
| 945 Line Composite | Brooktree BT261 | Clock = 21.7510 MHz<br>HSYNC = 800 clocks<br>VSYNC = 945 HSYNCs<br>Interlaced |
| VGA (640 x 480) | ICS AV9173 | Clock = 25.175 MHz<br>HSYNC = 800 clocks<br>VSYNC = 525 rows<br>Non-Interlaced |
| SVGA (800 x 600) | ICS AV9173 | Clock = 40 MHz<br>HSYNC = 1024 clocks<br>VSYNC = 625 rows<br>Non-Interlaced |

Upon the microprocessor 36 receiving the video format or mode of the incoming video data from the video input connector 10, the microprocessor performs a table look-up for the parameters in Table XI above, and programs the parameters into the sync detector 13, the sync separator 14, and the image size/position control unit 39. The parameters depicted in Table XI are provided by the component manufacturers. Thus, Table XI serves as a template for future video formats or modes.

Returning to FIG. 5*e*, the logic flow process proceeds to logic step 128, where the configuration switches 45 again are sampled. If no change in the timing parameters of the incoming video signal is detected at logic step 126, the logic flow process proceeds directly to logic step 128.

From logic step 128, the logic flow process proceeds to logic step 129 to compare previously determined image size parameters with current size parameters. If a change has occurred, the microprocessor at logic step 130 reprograms the image size/position control unit 39 with new size values (horizontal and vertical replication). If no change in image size is detected at logic step 129, or an image resealing occurs at logic step 130, the logic flow process proceeds to logic step 131*a*, where the microprocessor determines from the code previously read from the configuration switches 45 whether monochrome is to be processed. If so, the microprocessor determines at logic step 131*b* whether the color to monochrome equation in the color to monochrome reduction device 21 has been changed. If a change has occurred, the microprocessor programs the current equation into the device 21. If color rather than monochrome is indicated at logic step 131*a*, or a color to monochrome equation change is detected at logic step 131*b*, the logic flow process proceeds directly to logic step 133 of FIG. 5*f*.

At logic step 133, the microprocessor 36 determines whether the threshold level for detecting sync signals has changed. If not, the logic flow process proceeds directly to logic step 135. If so, the microprocessor at logic step 134 writes the new sync threshold to the sync detector 13 by way of line 49 leading through the sync separator 14 to line 26. The sync threshold allows the user to change the voltage level at which sync signals will be detected, and thereby provide for the detection of video signals with low amplitude sync signals. If no change in the sync threshold level is detected at logic step 133, or a new sync level threshold is written into the sync detector 13 at logic step 134, the logic flow process proceeds to the logic step 135 to determine whether an ignore power switch flag has been set as before described. If the flag has not been set, the logic flow process proceeds to logic step 136 where the microprocessor 36 reads the on/off switch 44 for 100 ms. If the switch is closed for the entire 100 ms, the logic flow process leaves the on-loop state and enters the off state at logic step 138. If the on/off switch 44 is found to be open at logic step 136, or the power switch flag has been set at logic step 135, the logic flow process proceeds to logic step 137. Once the power switch flag has been set, the on/off switch 44 is thereafter ignored.

At logic step 137, the microprocessor 36 decides whether the video signal has been removed by reading the outputs of the sync separator 14. If a video signal is not detected at logic step 137, the logic flow process leaves the on loop state and enters the standby state at logic step 143 of FIG. 5*h*. If the video signal is detected, however, the logic flow process proceeds from logic step 137 to logic step 118 of FIG. 5*d* and continues as before described.

Figure 5G:
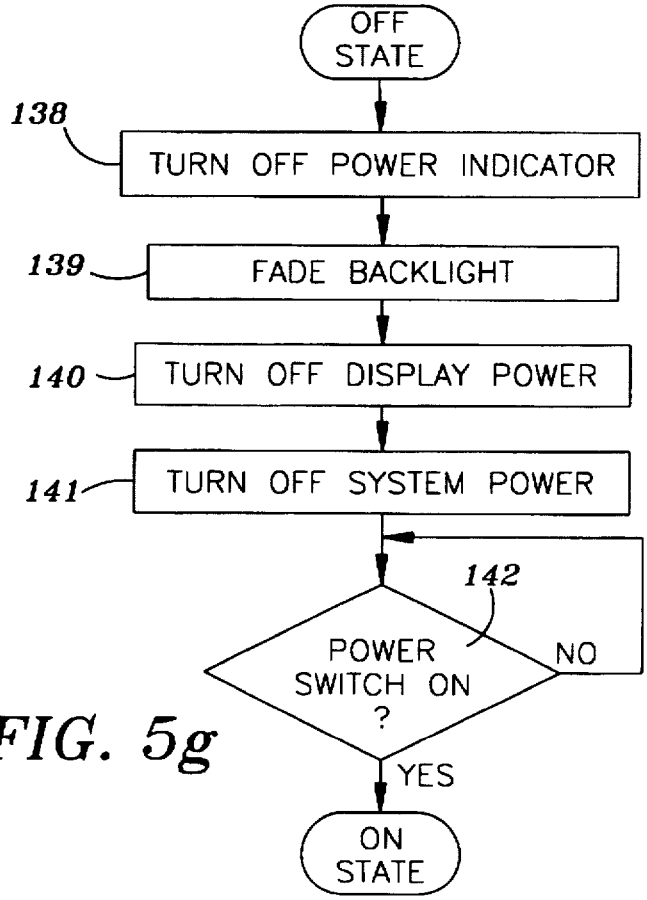

At logic step 138 of FIG. 5*g*, the microprocessor 36 issues a command to the power control circuits 53 by way of line 54 to turn the power indicator 61 off. Thereafter, at logic step 139, the microprocessor performs a table look-up to an internally stored power sequence table, and causes the power control circuits 53 to gradually turn the power to the backlight inverter power supply 58 off. The backlight thereby appears to fade out. The microprocessor next turns the flat panel display off at logic step 140, and then turns off the power to the rest of the electronic control system at logic step 141. The microprocessor thereafter enters a feedback loop at logic step 142 to repeatedly read the on/off switch 44 until the switch is closed. When the on/off switch is closed, the logic flow process leaves the off state and reenters the on state at logic step 110 of Figure 5*b*, where the logic flow process continues as before described.

Figure 5H:
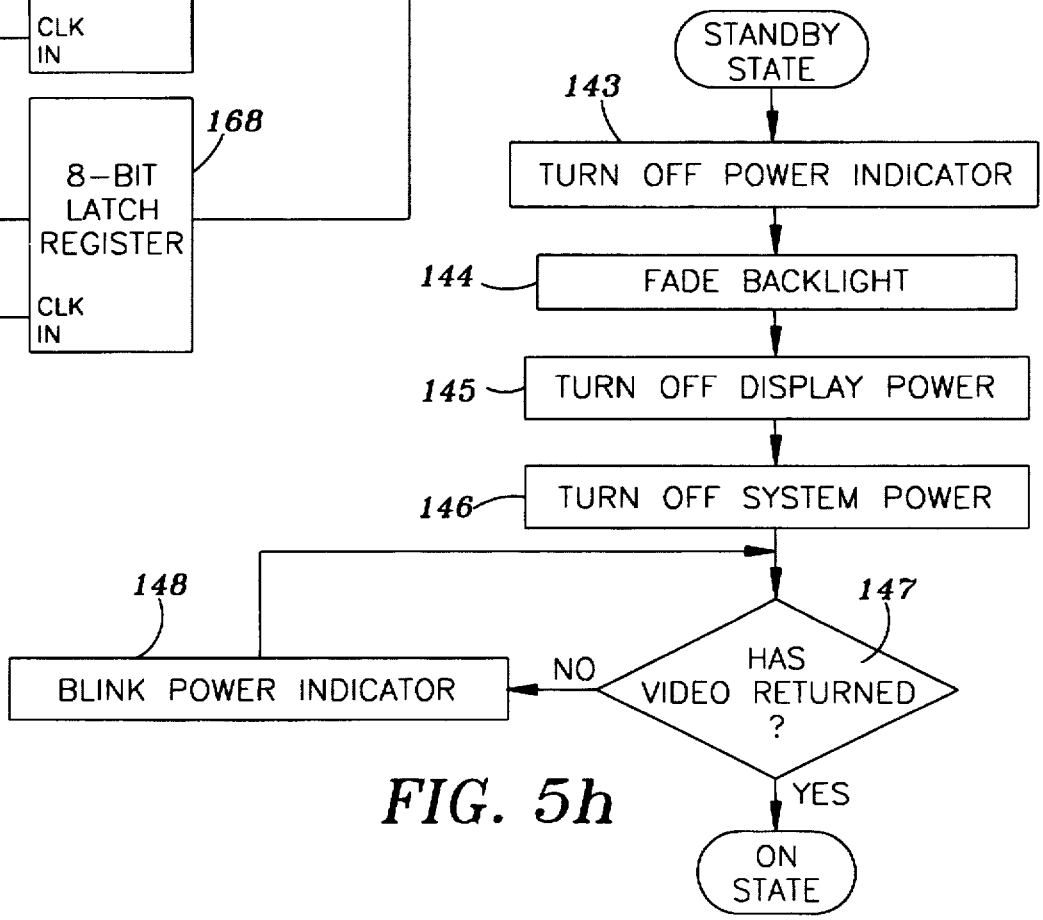

When the electronic control system of FIG. 1 has been powered up, and the video signal thereafter is lost, the logic flow process branches from logic step 142 of FIG. 5*g* to logic step 143 of FIG. 5*h* to enter the standby state. Then, the microprocessor 36 turns the power indicator 61 off at logic step 144, fades the backlight out at logic step 145, and turns the rest of the electronic control system off at logic step 146 as before described. Next, the logic flow process enters a feedback loop where the sync signals at the output of the sync separator 14 are read at logic step 147, and the power indicator 61 is caused to blink at logic step 148 if no video signal is present. If a video signal is detected at logic step 147, however, the logic flow process leaves the standby state and enters the on state at logic step 110 of FIG. 5*b* as before described.

Figure 6:
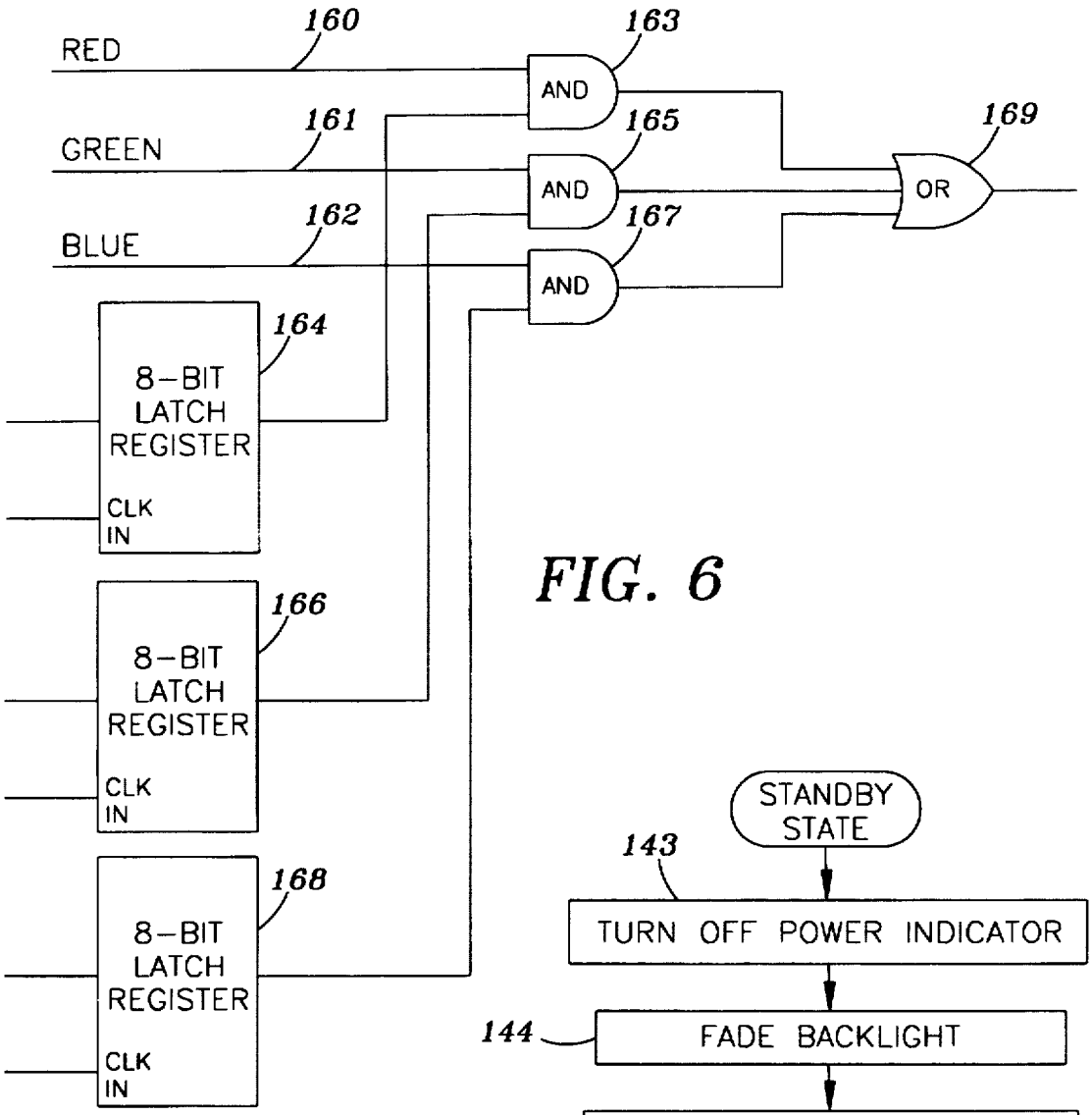
FIG. 6 is a logic schematic diagram of the color to monochrome reduction device 21 of FIG. 1.

Referring to FIG. 6, the interconnection of logic components of the color to monochrome reduction device 21 for one of eight bits of video signal data is illustrated. It is to be realized that each of the AND and OR gates would be duplicated eight times to accommodate the full eight bit outputs of the video input selector 12 and the microprocessor 36. The lines 160, 161 and 162 are respectively cocolor video on line 1s of A/D converters 19, 22 and 23. Red color video on line 160 is applied to one input of an AND gate 163, the other input of which is connected to an output of an eight bit latch register 164. In like manner, one input of an AND gate 165 is connected to line 161 to receive green color video data, and the other input of gate 165 is connected to an output of an eight bit latch register 166. Further, one input of an AND gate 167 is connected to line 162 to receive blue color data, and the other input to gate 167 is connected to an output of an eight bit latch register 168. The inputs of the latches 164, 166 and 168 are connected to corresponding outputs of the microprocessor 36, which also supplies the clock signals controlling the latches.

The outputs of the AND gates 163, 165 and 167 are connected to inputs of OR gate 169, the output of which is connected to one input of the green color frame buffer 25 of FIG. 1.

In operation, when color video information is to be displayed on a monochrome flat panel display, one of the equations set forth in Table I above is programmed by the microcontroller 36 into the color to monochrome reduction device 21, and weighting values for red, blue and green color are written by the microprocessor into the latch registers 164, 166, and 168. More particularly, latch 164 contains the weighting for the color red, latch 166 contains the weighting for the color green, and latch 168 contains the weighting for the color blue. The AND gates 163, 165 and 167 transition to a logic one level only when both a color video data signal and a weighting for that color are received. Thus, only weighted color values are allowed to pass to OR gate 169, where the color data is mixed only in the amounts indicated by the weightings. The output of OR gate 169 is one bit of monochrome grey scale. As before stated, the OR gate would be duplicated eight times in handling eight sets of video data. The above process may be represented by the following equation:

$$\begin{aligned}\text{Monochrome Data [bits 0–7]} = \\ &\{\text{Red Data [bits 0–7]}\} \cdot \{\text{Red Weighting [bits 0–7]}\} + \\ &\{\text{Green Data [bits 0–7]}\} \cdot \{\text{Green Weighting [bits 0–7]}\} + \\ &\{\text{Blue Data [bits 0–7]}\} \cdot \{\text{Blue Weighting [bits 0–7]}\},\end{aligned}$$

where the "+" sign refers to a logical OR and the "●" sign refers to a logical AND function.

As previously stated, when a monochrome video signal is to be displayed on a flat panel color display, green video data is fed from the green color A/D converter 22, through the color to monochrome reduction device 21 and green color frame buffer 25, to the flat panel interface module 30 of FIG. 1. Thereafter, under control of the microprocessor 36, the green video data is supplied to the red, green and blue inputs of the flat panel display to have the monochrome image displayed in black and white.

For a monochrome to monochrome flat panel display, the green video data is fed without modification from the green color frame buffer 25, through the flat panel interface module 30 to the monochrome display screen. Similarly, for a color to color flat panel display, the microprocessor 36 causes the contents of the frame buffers 20, 24 and 25 to pass without modification through the flat panel interface module 30 to the respective red, blue and green inputs of the display screen.

Figure 7:
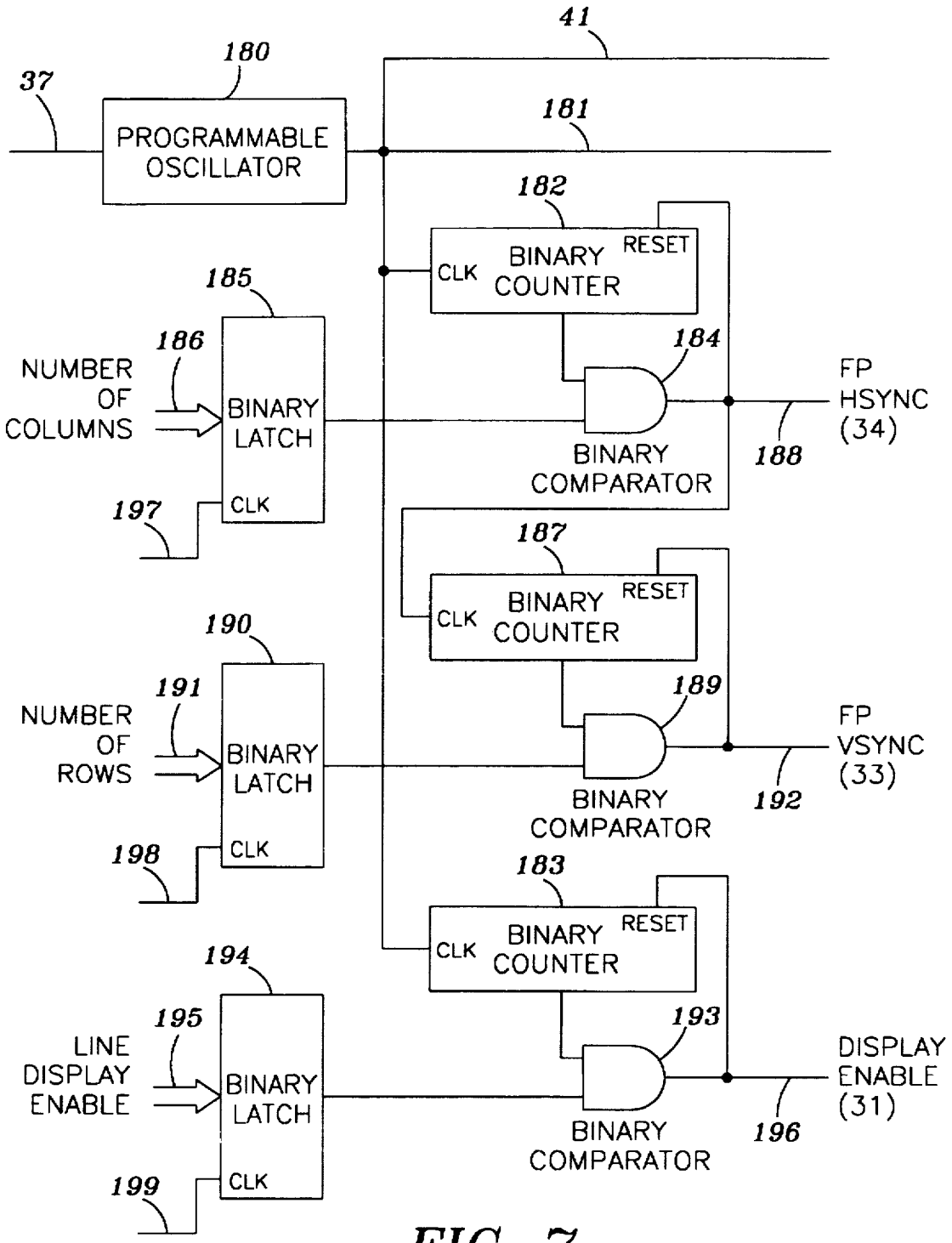
FIG. 7 is a logic schematic diagram of the flat panel timing generator 29 of FIG. 1.

FIG. 7 illustrates the logic circuit of the flat panel timing generator 29, where a programmable oscillator 180 receives a programming code from microprocessor 36 by way of line 37 of FIG. 1. In response thereto, the oscillator generates a flat panel pixel clock on line 181 of FIG. 7 which is supplied by way of line 32 to one input of the flat panel interface module 30, and by way of line 41 to one input of the image size/position control unit 39. This clock signal is the same clock signal as that used to create the flat panel timing, and also is used to create frame buffer memory addresses of output video data. In this manner, data is presented to the flat panel interface module 30 at the precise time that the input timing signals require. The pixel clock output of oscillator 180 also is applied to the clock input of a binary counter 182, and to the clock input of a binary counter 183. The output of counter 182 is applied to one input of a binary comparator 184, a second input of which is connected to the output of a binary latch 185. The latch in turn receives a count of the number of flat panel columns in a video image from the microprocessor 36 on bus 186.

The output of comparator 184 is electrically connected to the reset input of the counter 182, to the clock input of a binary counter 187, and to line 188 which is connected by way of line 34 to an input of the flat panel interface module 30. The output of counter 187 is applied to one input of a binary comparator 189. A second input of the comparator 189 is connected to the output of a binary latch 190, which receives a count of flat panel rows in a video image on bus 191. The output of the comparator 189 is applied to the reset input of counter 187 and to line 192 that is connected to an input of the flat panel interface module 30 by way of line 33.

The output of the counter 183 is electrically connected to one input of a binary comparator 193, a second input of which is connected to the output of a binary latch 194. The latch receives a line display enable value from the microprocessor 36 on bus 195. The output of the comparator 193 is applied to the reset input of counter 183 and to a display enable input of the flat panel interface module 30 by way of lines 196 and 31.

The clock inputs of the latches 185, 190 and 194 are supplied by the microprocessor 36 respectively on lines 197, 198, and 199.

In operation, the programmable oscillator 180 receives a programming code from the microprocessor 36 on line 37, and in response thereto the oscillator generates a flat panel pixel clock signal on lines 41 and 181. The microprocessor also loads the number of image columns and rows respectively in the latches 185 and 190, and a line display enable value into the latch 194. The row and column values are provided by a table hookup in response to the code received by the microprocessor 36 from the flat panel interface module 30 on line 35 of FIG. 1. The output of the latch 185 is compared to the output of the counter 182 by binary comparator 184, and when the count output equals the value loaded into the latch 185, the comparator issues a HSYNC signal on line 188, resets counter 182, and clocks the counter 187. In like manner, the number of rows value loaded into latch 190 is compared to the output of counter 187 by the comparator 189. When an equivalence is reached, the comparator issues a VSYNC signal on line 192, and resets counter 187.

The binary latches and counters are large enough to accommodate flat panel displays with sizes up to at least 2048 rows by 2048 columns. The programmable oscillator 180 also can accommodate flat panel displays with pixel clock rates up to 230 MHz.

The clock input to the counter 183 is supplied by the oscillator 180, and when the output of the counter 183 is equal to the output of latch 194, the binary comparator 193 resets counter 183 and issues a display enable signal on line 196. The display enable signal is required by a number of flat panel displays to provide correct horizontal positioning on the display screen.

Figure 8:
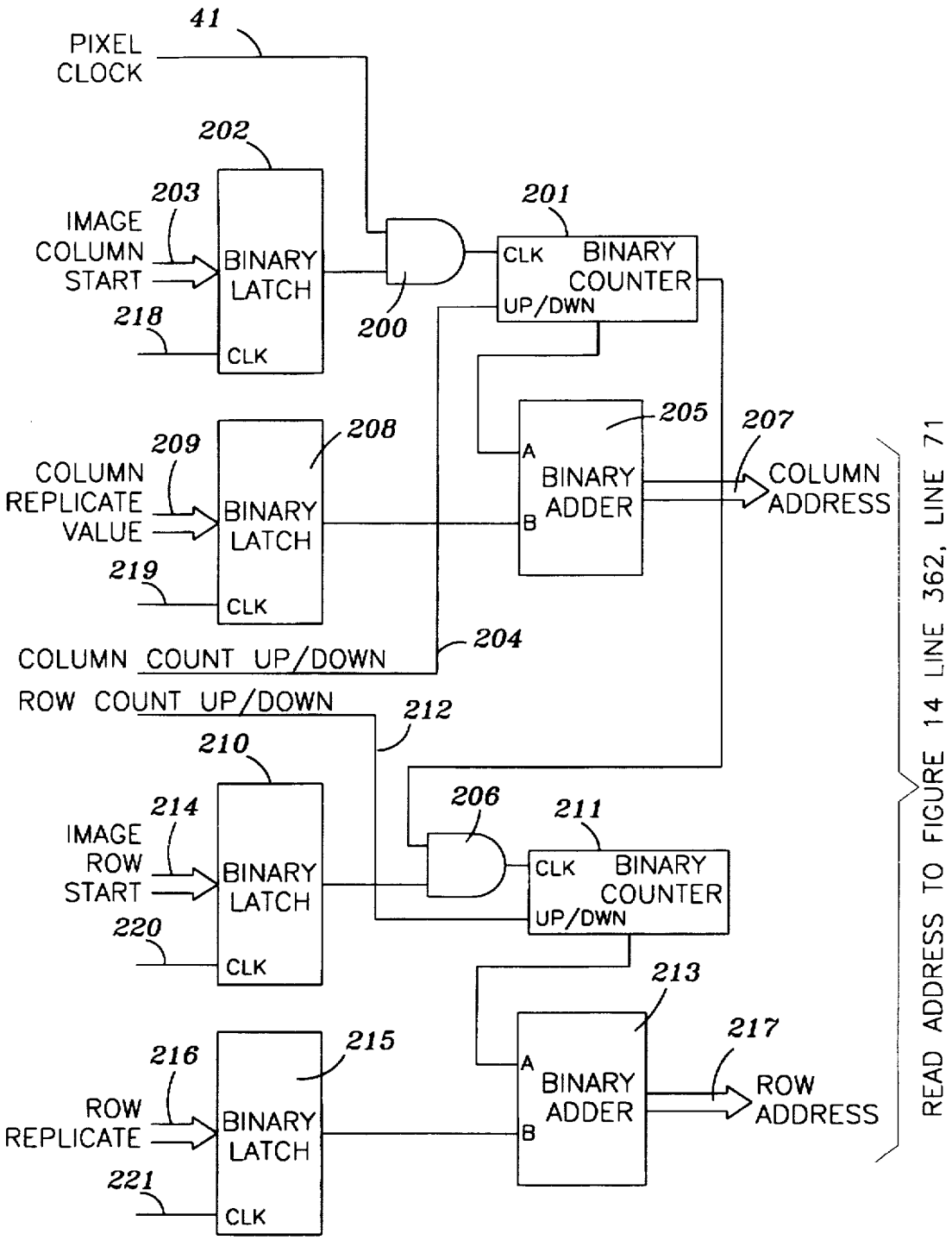
FIG. 8 is a logic schematic diagram of the image size/position control unit 39 of FIG. 1.

The logic schematic diagram of the image size/position control unit 39 is illustrated in FIG. 8, where a flat panel pixel clock from the flat panel timing generator 29 is supplied on line 41 to one input of an AND gate 200, the output of which is applied to the clock input of a binary counter 201. A second input of the gate 200 is connected to the output of a binary latch 202, which receives an image column start signal from the microprocessor 36 on cable 203.

The binary counter 201 also receives a column count up/down signal on line 204 from the microprocessor, and supplies a binary count value to a first data input of a binary adder 205. The overflow output of counter 201 is connected to one input of an AND gate 206. The output of the adder 205 is an output column address signal that is applied to bus 207. A second data input of the adder 205 is connected to the output of a binary latch 208, which receives a column replicate value on bus 209 from microprocessor 36.

A second input to gate 206 is connected to the output of a binary latch 210 and the output of the gate is connected to the clock input of a binary counter 211. The counter 211 also receives a row count up/down signal at its up/down input from the microprocessor 36 by way of line 212, and supplies a count output to a first data input of a binary adder 213.

The binary latch 210 receives an image row start value from the microprocessor on bus 214, and a second input of the adder 213 is connected to the output of a binary latch 215, the data input of which receives a row replicate signal from the microprocessor by way of bus 216. The output of the adder 213 is an output row address which is supplied to a bus 217. Clock inputs to the latches 202, 208, 210 and 215 are supplied by the microprocessor respectively on lines 218, 219, 220, and 221.

In operation, the image size/position control unit 39 provides image positioning, image size, and image orientation by modifying the memory addresses that are presented to the frame buffers 20, 24, and 25. The microprocessor 36 writes a column starting position into latch 202, the output of which enables the counter 201. The microprocessor also writes a column replicate value on bus 209 into latch 208, an image row start value into latch 210 by way of bus 214, and a row replicate value into latch 215 by way of bus 216. The information stored in the latches 202, 208, 210 and 215 are clocked to the latch outputs by clock signals issued by the microprocessor 36 respectively on lines 218, 219, 220 and 221.

The microprocessor 36 also issues a column count up/down control signal on line 204 to the up/down input of counter 201, and a row count up/down control signal on line 212 to the up/down input of counter 211. When the pixel clock signal on line 41 and the output of latch 202 are a logic one, the binary counter 201 is enabled and begins counting up or down, depending upon the logic level of line 204. Further, when the count value output of the counter 201 and the output of latch 210 are a logic one, the gate 206 enables the counter 211. The counter begins counting up or down depending upon the logic level of the control signal on line 212. A primary column address from counter 201 is applied to one input of the adder/subtractor 205, and the column replicate value of latch 208 is applied to the second data input of the adder/subtractor 205. The replicate value then is added or subtracted from the primary column address as determined by the sign of the replicate value. The resulting output of the adder/subtractor 205 is a column address which is applied by way of bus 207 to the frame buffer output control unit 42 by way of busses 207 and 71.

In like manner, when the overflow output of counter 201 and the image row start signal at the output of latch 210 are a logic one, the counter 211 is enabled, and the counter 211 counts up or down depending upon the logic level of the line 212. The output of the counter 211 is a primary row address from which the row replicate value at the output of latch 215 is added or subtracted depending upon the sign of the replicate value. The resulting output of adder/subtractor 213 is a row address which is applied by way of busses 217 and 71 to the frame buffer output control unit 42.

The table below illustrates how the input controls to the image size/position control unit 39 affect the image display on the flat panel screen.

TABLE XII

| INPUT | DISPLAY EFFECT |
|---|---|
| Image Column Start (Latch 202) | Move image left-to-left |
| Image Row Start (Latch 210) | Move image up / down |
| Column Replicate Value (Latch 208) | Expand/contract image horizontally |
| Row Replicate Value (Latch 215) | Expand/contract image vertically |
| Column Count Up/ Down | Image appears left-to-right<br>Image appears right-to-left |
| Row Count Up/ Down | Image appears top-to-bottom<br>Image appears bottom-to-top |

From the above, it may be seen that through the combined functions of the image size/position control unit 39, the user may control image position and image size, and cause the image scan out of the frame buffers to be right-to-left, left-to-right, top-to-bottom, or bottom-to-top.

Figure 9:
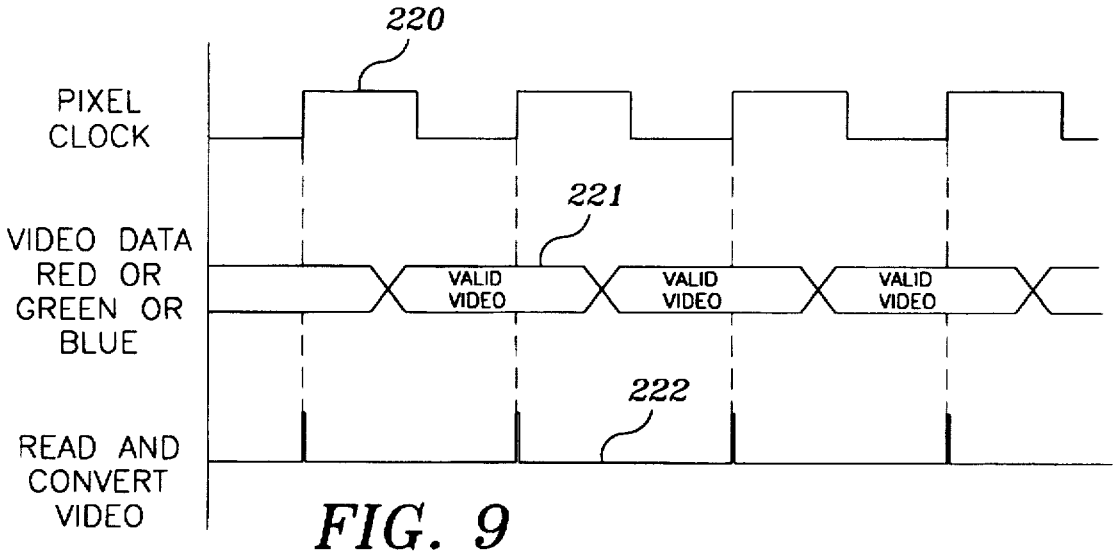
FIG. 9 is a graphical illustration of a video signal supplied by the video input selector 12 to the A/D converters 19, 22 and 23, and the clock signal generated by the pixel clock generator 28 of FIG. 1.
Figure 10:
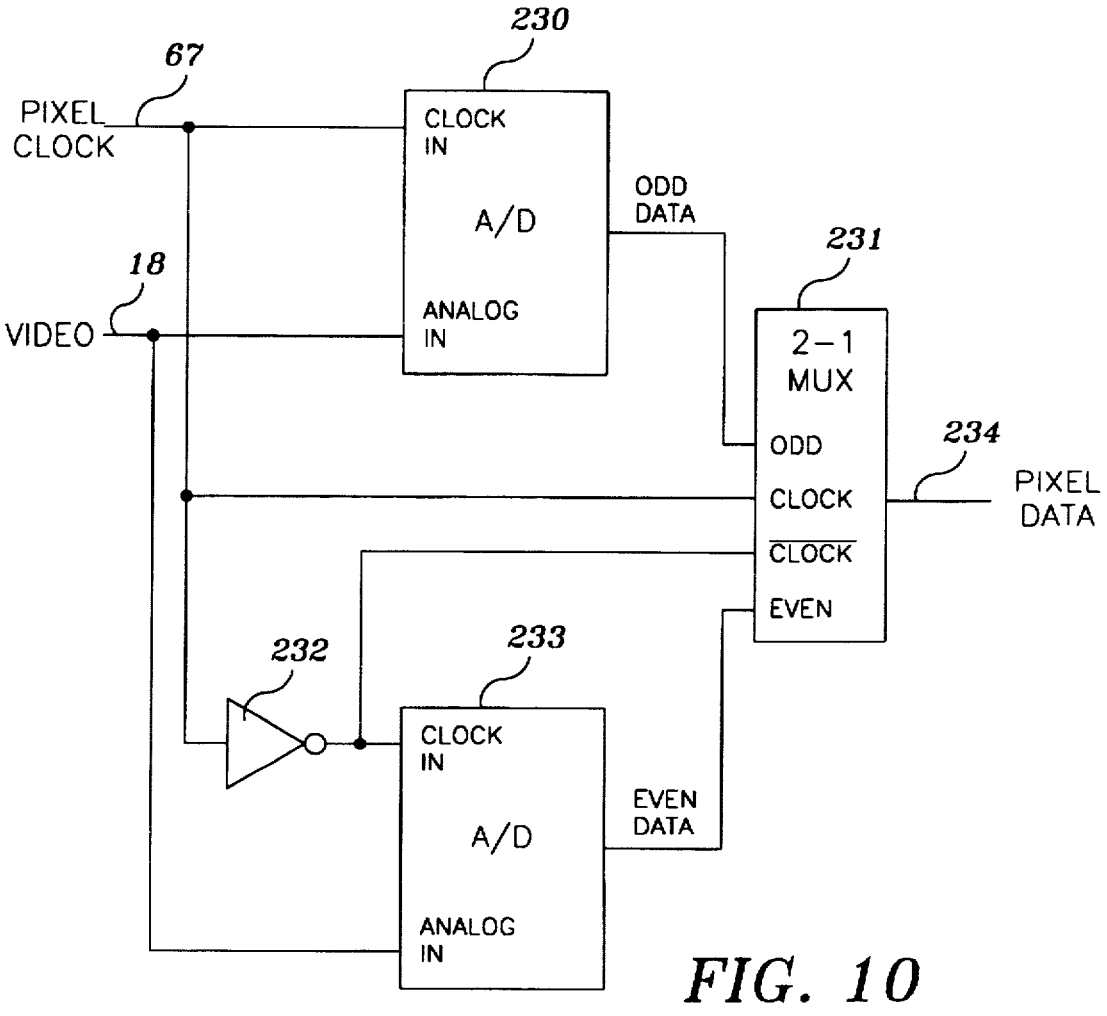
FIG. 10 is a logic schematic diagram of an A/D converter push-pull circuit as employed in the present invention.

FIGS. 9 and 10 illustrate a solution to a long recognized problem in converting analog video signals to digital signals at high video rates. Analog converters that can digitize video at rates above 40 MHz are expensive, consume excessive power, and are not available from numerous sources. In accordance with one aspect of the invention, the A/D converters 19, 22 and 23 are each dual A/D converters which digitize every other video pixel. That is, one converts odd columns while the other converts even columns of video data. As a result, slower A/D converters that are more cost effective, power conservative, and more generally available may be used.

FIG. 9 illustrates graphically a pixel clock waveform 220 generated by the pixel clock generator 28, a video signal waveform 221 supplied at the output of the video input selector 12, and a synchronous pulse waveform 222 which marks the low-to-high transitions of the pixel clock waveform 220. The pixel clock generator 28 creates a synchronous clock signal which has a rising edge that occurs when the video signal is stable, and which may be shifted left or right by the microprocessor 36 to provide a precise alignment of the pixel clock waveform 220 with the video signal waveform 221. The shifting of the pixel clock waveform has the effect of focusing the video image on the flat panel display screen.

Referring to FIG. 10, a dual A/D converter configuration as used in the invention is illustrated. A pixel clock signal on line 67 leading from an output of the pixel clock generator 28 is applied to the clock input of an A/D converter 230, to the clock input of a two-to-one multiplexer 231, and to the input of an inverter 232. The output of inverter 232 is connected to the clock input of an A/D converter 233 and to the inverted clock input of the multiplexer 231. The red color video signal output of video input selector 12, on line 18, is applied to the analog input of A/D converter 230, and to the analog input of A/D converter 233. The output of A/D converter 230 is connected to the odd pixel input of multiplexer 231, and the output of A/D converter 233 is connected to the even pixel input of the multiplexer 231.

In operation, the A/D converter 230 digitizes the odd video pixels of the video signal on line 18 in response to the clock signals on line 67, and the A/D converter 233 digitizes the even video pixels in response to the clock signal. The multiplexer 231 receives the outputs of the converters 230 and 233 at the pixel clock rate and combines them to form the digitized video signal on line 234. The line 234 leads to inputs of the red color frame buffer 20 and the color-to-monochrome reduction device 21. The A/D configuration of FIG. 10 is duplicated in the electronic control system of FIG. 1 for each of the red, green and blue colors.

Figure 11:
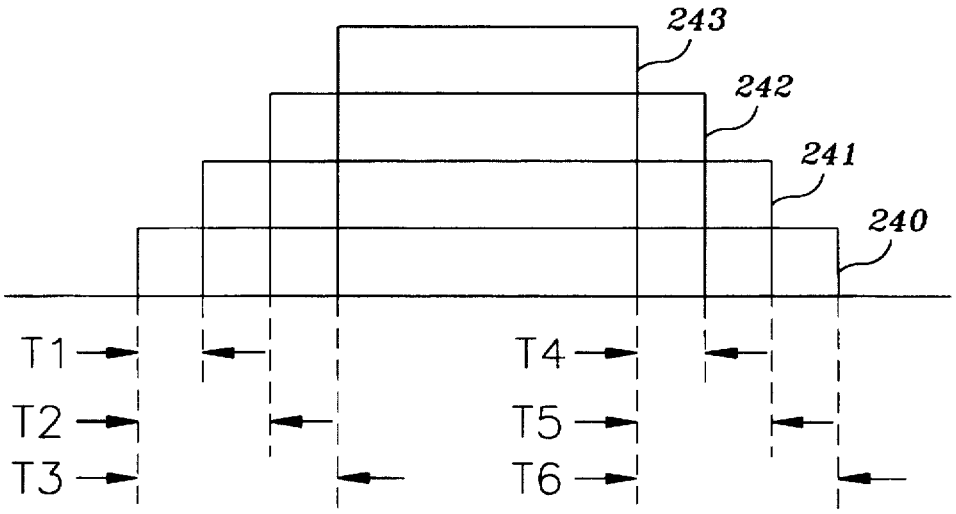
FIG. 11 is a graphic illustration of the power sequencing of the electronic control system of FIG. 1.
Figure 12A:
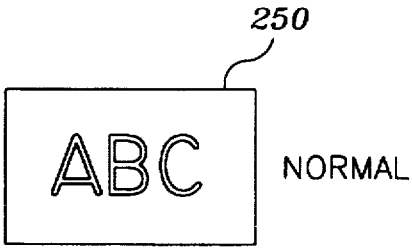
FIGS. 12*a*–12*e* illustrate the various image presentations that may be created in accordance with the invention.
Figure 12B:
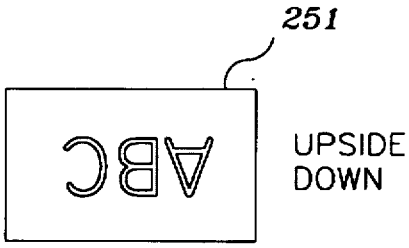
Figure 12C:
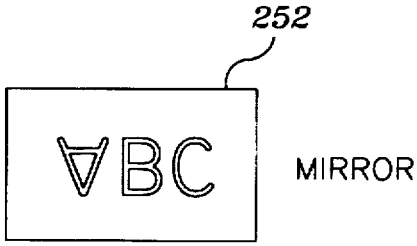
Figure 12D:
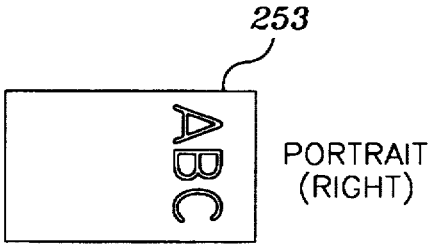
Figure 12E:
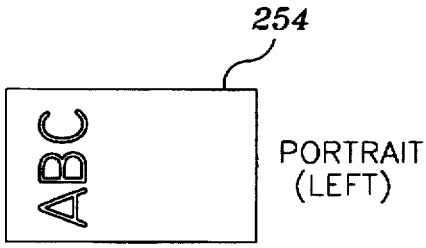

As previously stated, the electronics control system of FIG. 1 manages the distribution of power throughout the control system, as well to the flat panel display screen. FIG. 11 graphically illustrates the time sequencing of the electronic signals applied by the electronic control system of FIG. 1 to the flat panel interface module 30. More particularly, T1 seconds after the flat panel display is powered up as represented by a pulse 240, the synchronization signals generated by the flat panel timing generator 29 on lines 31, 32, 33 and 34 are applied to the module 30 as represented by the leading edge of a pulse 241. T2 seconds after the leading edge of pulse 240, the data signals at the outputs of buffers 20, 24 and 25 are clocked by the frame buffer output control unit 42 into the module 30 as represented by the leading edge of a pulse 242. T3 seconds after the leading edge of pulse 240, as represented by the leading edge of a pulse 243, the power control circuits 53 energize the backlight inverter power supply 58 to cause a voltage to be applied to line 59, and thereby turn on the backlight. When power is to be removed from the electronic control system of FIG. 1, a power off sequence occurs with the backlight being turned off first as represented by the trailing edge of pulse 243. T4 seconds later, power to those hardware components of the electronic control system which are in the video data stream is turned off as represented by the trailing edge of pulse 242. T5 seconds after backlight turn off, power to those hardware components of the electronic control system in the synchronization signal generation stream is turned off as represented by the trailing edge of pulse 241. T6 seconds after backlight turn off, the power to all remaining hardware of the electronic control system is turned off as represented by the trailing edge of pulse 240. It is to be recognized that for some flat panel displays, all power may be turned off at the same time. That is, T4, T5 and T6 are each zero seconds in duration.

FIG. 12 is a graphic illustration of the variety of image presentations that are provided by the electronic control system of FIG. 1. Presentation 250 shows a straight up and down image, while presentation 251 presents an upside down image. Further, presentation 252 shows a mirror image. The above described portrait images are shown in presentations 253 and 254 as respectively a portrait right image and a portrait left image.

Figure 13A:
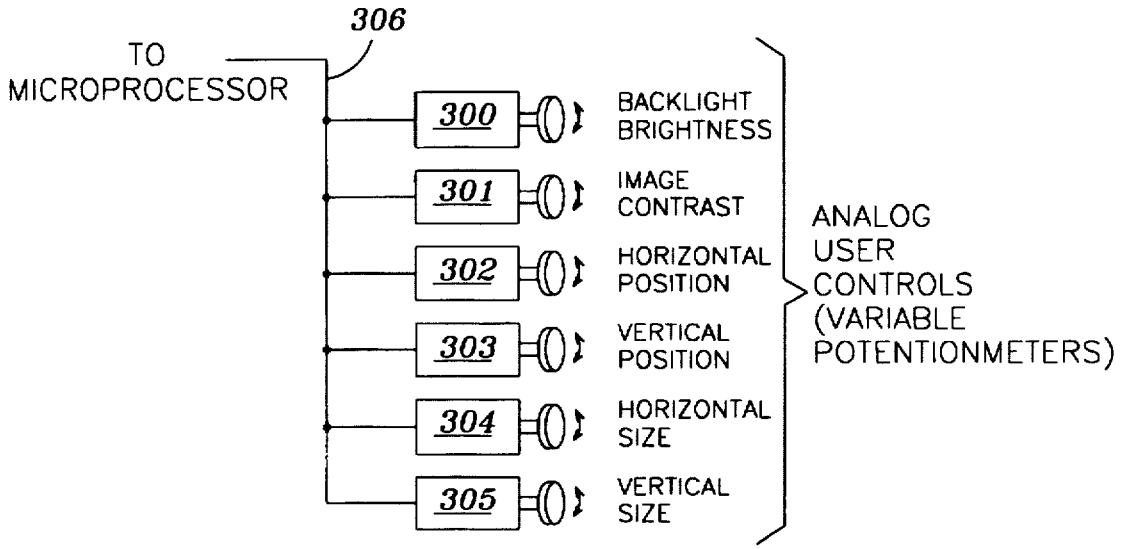
FIG. 13*a* is an illustration of the user analog controls of the electronic control system of FIG. 1.
Figure 13B:
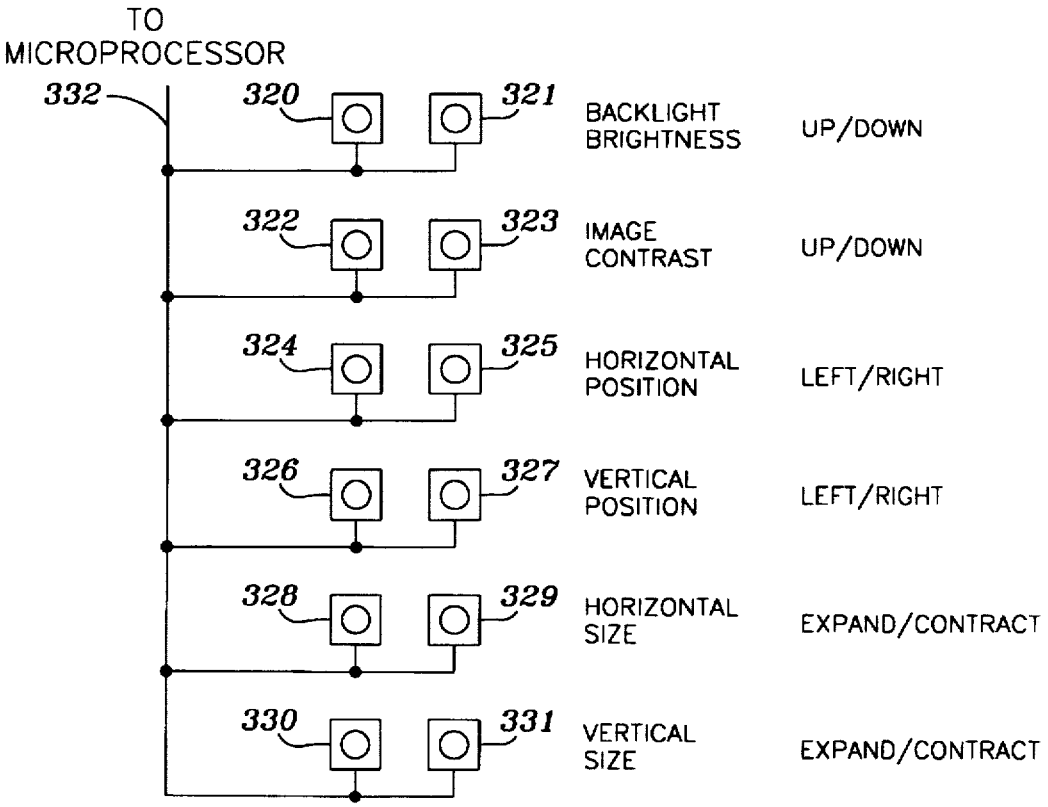
FIG. 13*b* is an illustration of the user digital controls of the electronic control system of FIG. 1.

FIGS. 13*a* and 13*b* illustrate the analog controls 46 and digital controls 47 of FIG. 1. Referring to FIG. 13*a*, the analog controls are comprised of a bank of variable potentiometers 300, 301, 302, 303, 304, and 305. Each of the potentiometers includes a reference voltage of 5 volts which is varied by rotating the knobs of the potentiometers. The potentiometer 300 controls backlight brightness, the potentiometer 301 controls image contrast, potentiometer 302 controls horizontal position of the video image on the display screen, potentiometer 303 controls the vertical position of the video image on the display screen, potentiometer 304 controls the horizontal size of the video image, and potentiometer 305 controls the vertical size of the image. As was disclosed in more detail in connection with the description of FIGS. 5*a*–5*h*, the microprocessor 36 periodically reads the outputs of the potentiometers on bus 306 and implements the user commands. Bus 306 carries the outputs of each of the potentiometers 300–305. More particularly, in response to the potentiometers 300 and 301, the microprocessor issues control signals to the power control circuits 53 of FIG. 1 to control backlight brightness and image contrast. Further, in response to the potentiometers 302–305, the microprocessor issues control signals on line 37 of FIG. 1 leading to the flat panel timing generator 29, and on line 38 leading to the image size/position control unit 39 to control the size and position of the video image on the display screen.

Referring to FIG. 13*b*, the digital controls 47 include a bank of six push-button switch pairs. Switches 320 and 321 control backlight brightness, switches 322 and 323 control image contrast, switches 324 and 325 control the horizontal position of the video image on the display screen, switches 326 and 327 control the vertical position of the video image, switches 328 and 329 control the horizontal size of the video image, and switches 330 and 331 control the vertical size of the video image. The microprocessor 36 reads the logic voltage output of the switches on bus 332 and implements commands as follows. When the switch 320 is depressed, but the switch 321 is not, a command to increase backlight brightness is indicated. If the switch 321 is depressed, but the switch 320 is not, a command to decrease backlight brightness in indicated. Any other setting of the switches is interpreted to be a non-operative condition. The bus 332 carries the outputs of each of the push button switch pairs.

Similarly, when switch 322 is depressed, but switch 323 is not, a command to increase image contrast is indicated. If switch 323 is depressed, but switch 322 is not, a command to decrease image contrast is indicated. Again, any other setting of the switches is interpreted to be a non-operative condition.

The remaining switch pairs operate similarly, with switches 324 and 325 controlling the movement of the video image to the left or to the right, switches 326 and 327 controlling the movement of the video image up or down, switches 328 and 329 controlling the horizontal expansion or contraction of the video image, and the switches 330 and 331 controlling the vertical expansion or contraction of the video image.

Figure 14:
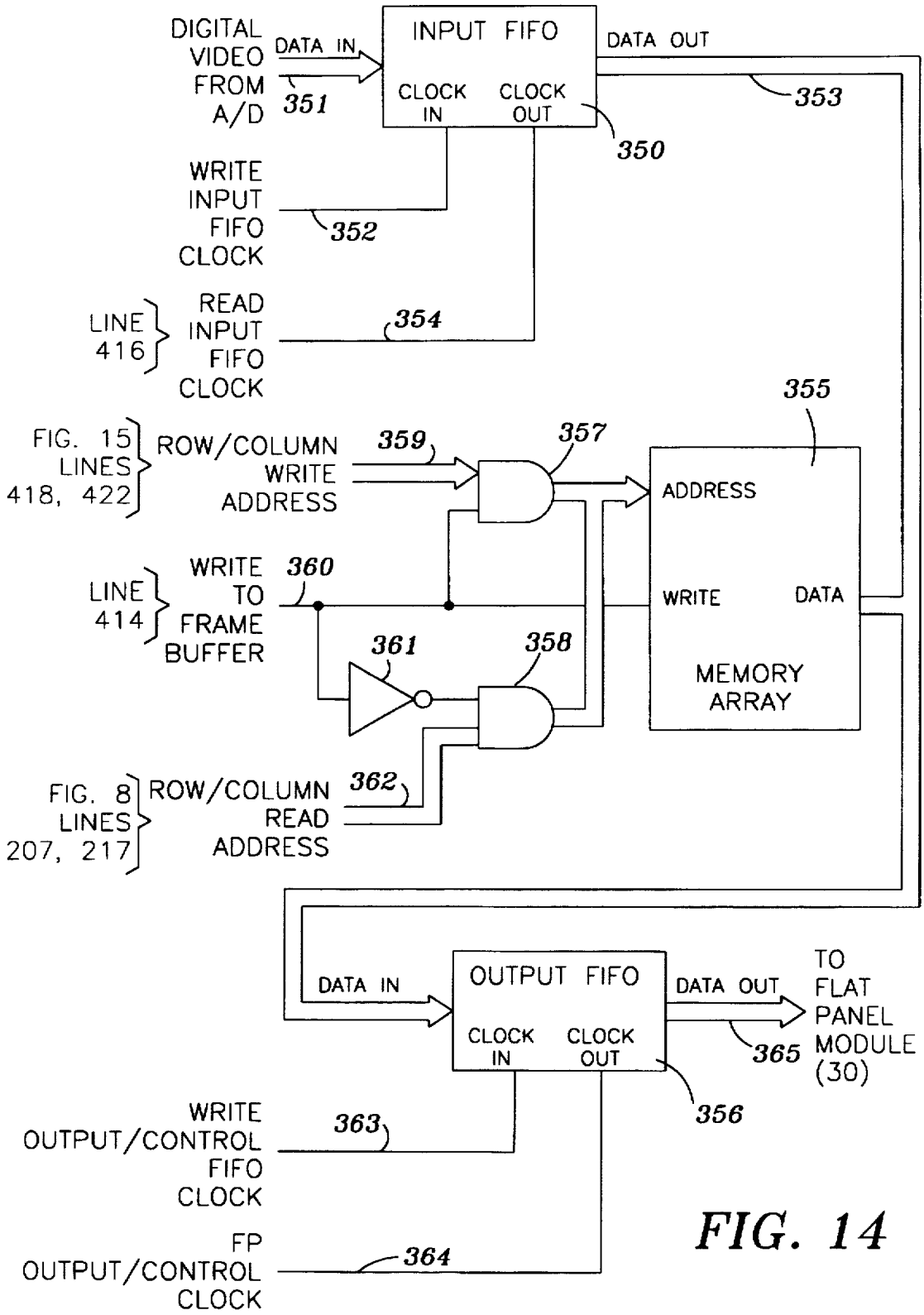
FIG. 14 is a logic schematic diagram of the system used in the frame buffers 20,24 and 25 of FIG. 1.

Referring to FIG. 14, the structure of frame buffers 20, 24 and 25 is shown in more detail with an input FIFO unit 350 receiving digital video data from one of A/D converters 19, 22, or 23 on a bus 351 at a clock rate received from the frame buffer input control unit 27 on line 352, the FIFO supplies video to a bus 353 at a different clock rate as controlled by the frame buffer input control unit 27 by way of line 354. The data output of the FIFO 350 also is supplied to inputs of a static RAM memory array 355 and an output FIFO 356.

The address input of the memory array 355 is connected to the outputs of AND gates 357 and 358. One input of the gate 357 is connected to a bus 359 on which frame buffer input control unit 27 supplies a row/column write address signal. The second input of the gate 357 is connected to a line 360, which in turn is connected to a write input of the memory array 355 and to the input of an inverter 361. The output of inverter 361 is connected to a first input of gate 358, the second input of which is connected to a bus on which the frame buffer output control unit 42 supplies a row/column read address signal.

The clock-in input to the FIFO 356 receives a write output clock signal on line 363 from control unit 42 on line 65, and a clock out signal from the control unit 42 on a line 364. The data output of the FIFO 356 is connected to a bus 365 leading to the flat panel interface module 30.

Each of the frame buffers 20, 24, and 25 of FIG. 1 has the architecture illustrated in FIG. 14. As before stated, each frame buffer must be able to store video data at one video rate, and simultaneously read video data out of the frame buffer at a different video rate. The architecture of FIG. 14 is a more cost effective system to that of the dual-ported memories in general use.

In operation, digital video data is received by the input FIFO 350 at the video rate appearing on line 352. Simultaneously, video data is read out of the FIFO and into the memory array 355 at the video rate determined by the clock signal from the frame buffer input control unit 27 on line 354.

Data is read out of or written into the memory array 355 as controlled by the logic voltage on line 360 from the input control unit 27. Further, the addresses of the memory locations into which data is written is controlled by gate 357, and the addresses of the memory locations from which data is read is controlled by gate 358. From the memory array 355, the video data is read into the FIFO 356 at the video rate of the flat panel display as determined by the clock signal appearing on line 363 from the frame buffer output control unit 42, and read out of the FIFO at a different clock rate received from the frame buffer output control unit 42 on line 364. The video image data for the flat panel display appears at the output of FIFO 356. The output FIFO allows video data to continue to be supplied to the flat panel display when the memory array 355 is unavailable during write cycles.

Figure 15:
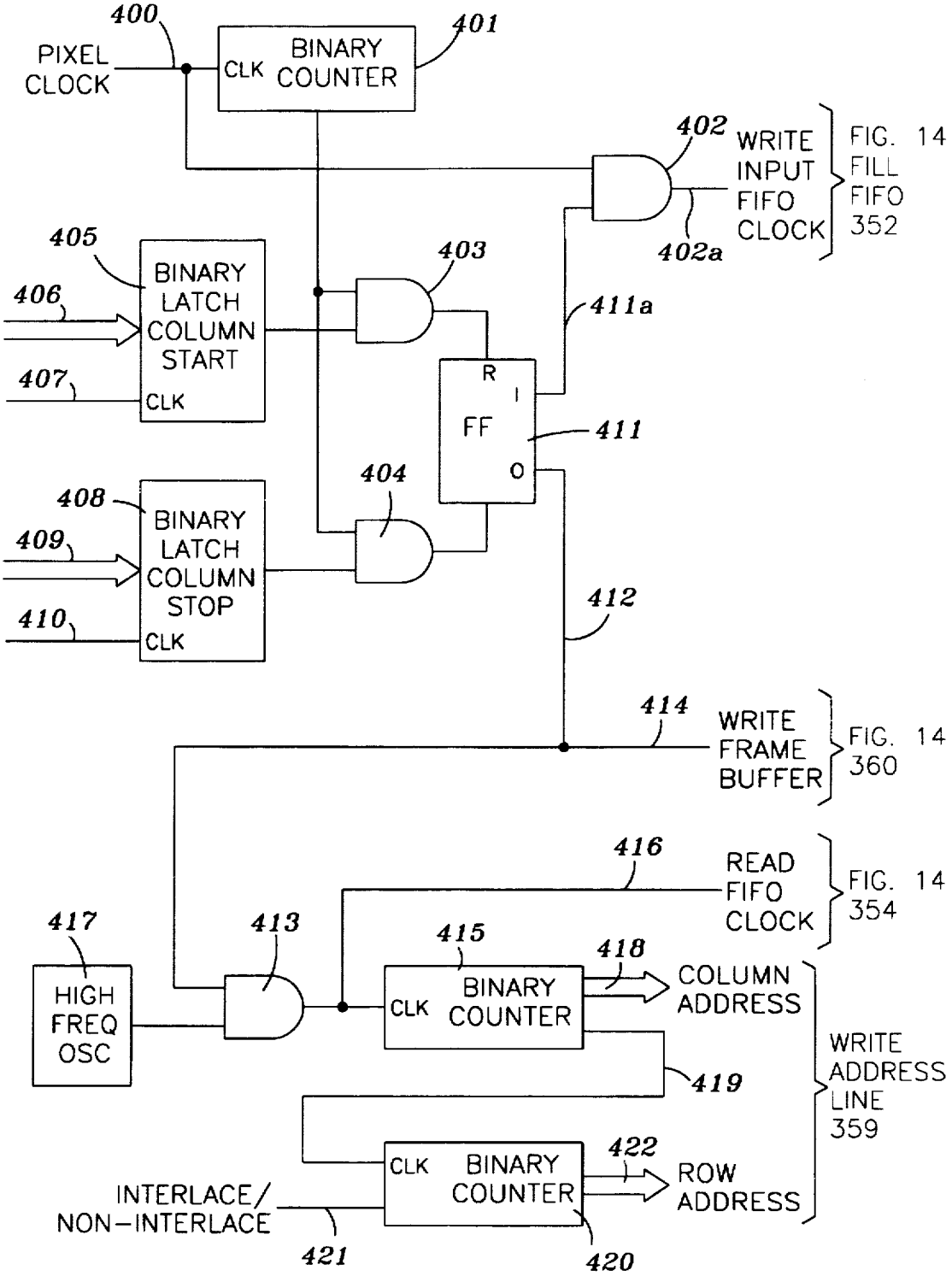
FIG. 15 is a logic schematic diagram of the frame buffer input control unit 27 of FIG. 1.

FIG. 15 illustrates the logic architecture of the frame buffer input control unit 27 of FIG. 1. Referring to FIG. 15, a pixel clock signal is received on line 400 from the pixel clock generator 28 of FIG. 1, and applied to the clock input of a binary counter 401, and to one input of an AND gate 402. The output of the binary counter in turn is applied to one input of a binary comparator 403, and to one input of a binary comparator 404. A second input of comparator 403 is connected to the output of a binary latch 405, the data input of which is connected to a bus 406 on which a column start value is received from the microprocessor 36. The clock input of the latch 405 is connected to control line 407 on which clock signals are received from the microprocessor. A second input to the comparator 404 is connected to the data output of a binary latch 408, the data input of which is connected to a bus 409 on which a column stop value is received from the microprocessor. The clock input to latch 408 is connected to line 410 leading from the microprocessor.

The output of comparator 403 is connected to the R input of an RS flip-flop 411, and the output of comparator 404 is connected to the S input of the flip-flop. A first output of the flip-flop is connected by way of a line 411*a* to a second input of gate 402, and a second output of the flip-flop is connected by way of a line 412 to one input of an AND gate 413 and to line 414 leading to frame buffers 20, 24 and 25. The output of gate 413 is connected to the clock input of a binary counter 415 and to a line 416 also leading to the frame buffers. A second input to the gate 413 is connected to the output of a 50–100 MHz or higher high frequency oscillator 417.

The output of the counter 415 is connected to bus 418 leading to frame buffers 20, 24, and 25. An overflow output of the counter 415 is supplied to a line 419 leading to the clock input of a binary counter 420. A interlace/non-interlace control signal is received at an input of the counter 420 on a control line 421 leading from the microprocessor. This input is used to modify the least significant address bit of the write row address to the frame buffers 20, 24 and 25. This allows odd/even or sequential row storage to take place.

In operation, the microprocessor 36 programs the latches 405 and 408 with the start and stop location of the incoming video image. More particularly, the microprocessor supplies column start data on bus 406 and column stop data on bus 409 in programming the latches. The data stored in the latches 405 and 408 is clocked to their outputs by the microprocessor by way of lines 407 and 410, and respectively applied at inputs to the binary comparators 403 and 404 where they are compared to the output of the counter 401. The outputs of the comparators 403 and 404 control the operation of the flip-flop 411, and thereby create a signal on line 411*a* that corresponds to the time that the video image is present on the incoming video line at the output of the video input connector 10 of FIG. 1. The logical inverse of the signal on line 411*a* appears on line 412 which gates the output of the oscillator 417 into the counters 415 and 420. The counters provide a write column address on bus 418 and a write row address on buss 422, with each bus leading to the bus 70 of FIG. 1. The timing of the incoming video data is indicated by the pixel clock on line 400, the occurrence of valid image data is indicated by the signal on line 411*a*, and the time that data can be written into the frame buffers 20, 24 and 25 is indicated by the signal on line 412.

Figure 16:
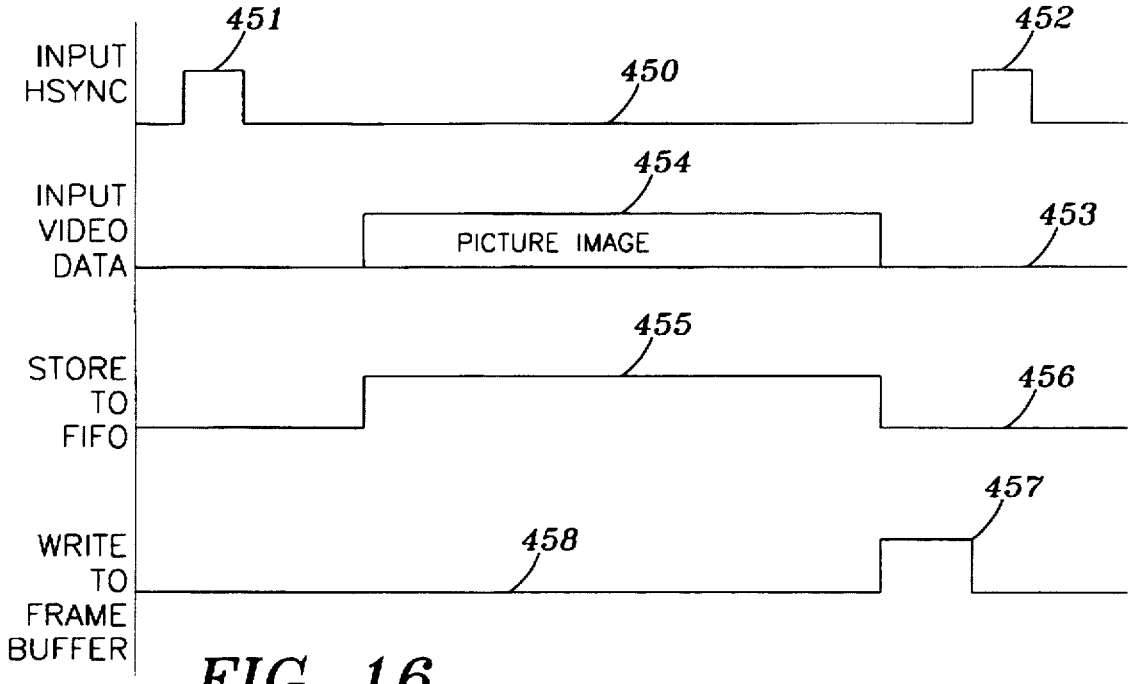
FIG. 16 is a timing diagram of the operation of the frame buffer input control unit 27 of FIG. 15.

FIG. 16 is a timing diagram of the operation of the frame buffer input control unit 27 of FIG. 1, where waveform 450 is the HSYNC output of the sync separator 14 of FIG. 1 with pulses 451 and 452. Waveform 453 represents an incoming video signal at the output of the video input selector 12 of FIG. 1, and the pulse 454 of waveform 453 represents the time period during which the image content of the video signal occurs. The microprocessor determines in its format determination tables that the image content represented by the pulse 454 will occur some time after the pulse 451. At the time of the occurrence of the pulse 454, the microprocessor causes the frame buffer input control unit 27 to generate an enable signal on control line 411*a* of FIG. 15, and thus at the output of gate 402 of FIG. 15, to clock data into the input FIFO 350 of FIG. 14.

Continuing with the discussion of FIG. 16, after the enable signal on line 411*a* is generated as represented by pulse 455 of waveform 456, the microprocessor 36 causes the frame buffer input control unit 27 to generate a logic signal on lines 412 and 414 of FIG. 15 as represented by pulse 457 of waveform 458 of FIG. 16. In response thereto, the memory array 355 of FIG. 14 is filled with the incoming video data of waveform 454 of FIG. 16.

Figure 17:
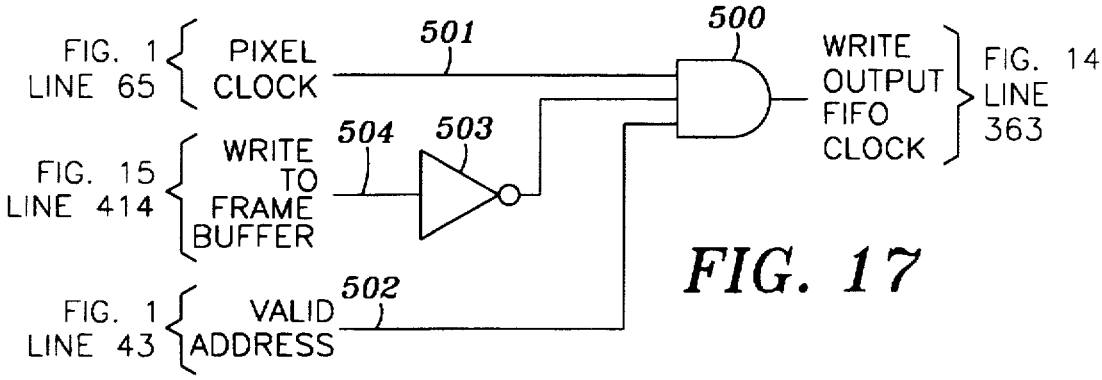
FIG. 17 is a logic schematic diagram of the frame buffer output control unit 42 of FIG. 1.

FIG. 17 illustrates in logic schematic form the frame buffer output control unit 42 of FIG. 1. More particularly, a logic AND gate 500 receives a pixel clock signal on line 501 from the flat panel timing generator 29 by way of line 41, the image size/position control unit 39 and line 65 of FIG. 1. Further, a write to frame buffer signal is received on line 504 from line 414 of FIG. 15. The valid address signal 502 is received by the microprocessor 36 on line 43. This signal is set by the microprocessor to allow video data to be read from the frame buffers 20, 25 and 24 of FIG. 1.

With the frame buffers operating in a fully asynchronous manner, video data may be read out of the frame buffers and through the output FIFO 356 to the flat panel display. During the brief "burst write" time, the frame buffer is being written into, and therefore cannot be read. However, the output FIFO contains enough video data so that output to the flat panel display is not interrupted. The output FIFO is not filled during the frame buffer write time, but the FIFO continues to output data to the flat panel display.

Figure 18:
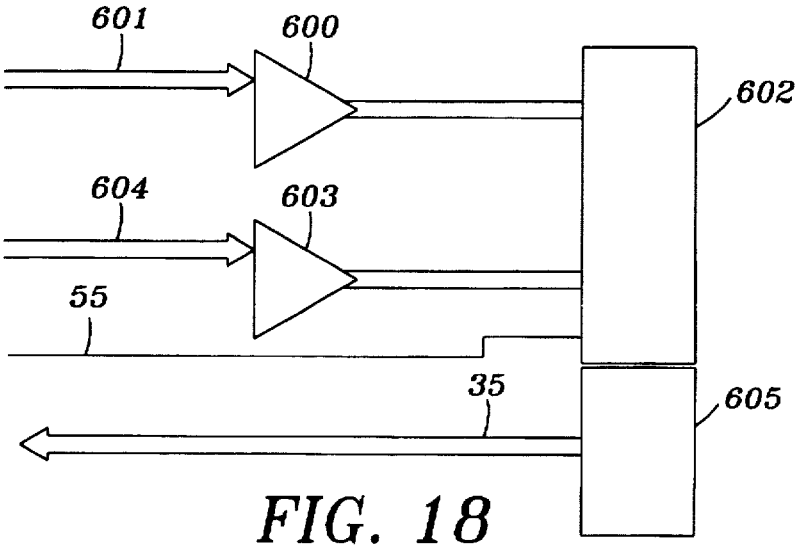
FIG. 18 is a logic schematic diagram of the flat panel interface module 30 of FIG. 1.

Referring to FIG. 18, a functional block diagram of the flat panel interface module 30 of FIG. 1 is shown, with a 24 bit driver 600 receiving the output video from the frame buffers 20, 24 and 25 of FIG. 1 on bus 601 of FIG. 18. The output of the driver 600 is connected to one input of a connector 602, to which a connector mate of the flat panel display attaches. It is to be understood that the connector 602 may be different for each flat panel display type as will be determined from manufacturer specifications for the connector type. A second input to the connector 602 is connected to the output of a four bit driver 603, which receives timing sync signals by way of a bus 604. The bus 604 carries the enable, clock, VSYNC, and HSYNC signals on lines 31–34 of FIG. 1.

A third input of the connector 602 of FIG. 18 is connected to the line 55 leading from the power circuits 53 of FIG. 1. The flat panel interface module 30 also is comprised of a jumper block 605 which in turn is comprised of a pattern of +5 v and ground strapings that represent a code pattern. The jumper block output is applied to line 35 leading to the microprocessor 36 of FIG. 1.

In operation, the driver 600 receives red, green and blue color video from the frame buffers 20, 24 and 25 of FIG. 1, and the driver 603 receives the timing sync signals supplied by the flat panel timing generator 29 of FIG. 1. Under the control of the generator 29 of FIG. 1, the drivers provide their contents to the connector 602, and thus to the flat panel display. Power for the flat panel display is provided by the power circuits 53 of FIG. 1 on line 55 leading to the connector 602 of FIG. 18.

The jumper block 605 is set with a code as before described. The code is based upon flat panel display parameters supplied by the manufacturer, and are applied to the microprocessor 36 by way of line 35.

The invention has been described and shown with reference to particular embodiments, but variations within the spirit and scope of the general inventive concept will be apparent by those skilled in the art. Accordingly, it should be clearly understood that the form of the invention as described and depicted in the specification and drawings is illustrative only, and is not intended to limit the scope of the invention. All changes which come within the meaning and range of the equivalence of the claims are therefore intended to be embraced therein.

What is claimed is:

1. An electronic control system receiving a video signal and any one video type of a plurality of video types from a video signal source for visual presentation on a flat panel display, which comprises:

a universal video input selector means for receiving said any one video type and automatically determining video format of said video signal, and for automatically extracting synchronization components and image components from said video signal;

color reduction means in electrical communication with said universal video input selector means for producing digital signals from said image components and reducing said digital signals to a monochrome display image when said video signal is a color signal and said flat panel display is a monochrome display, and otherwise passing said digital signals through without reduction;

storage means in electrical communication with said universal video input selector means and said color reduction means for storing said monochrome display image when said video signal is said color signal and said flat panel display is said monochrome display, and otherwise storing said digital signals; and timing control means in electrical communication with said universal video input selector means, said color reduction means, and said storage means for controlling processing of said video signal at an incoming video rate, and controlling a reading of said storage means for asynchronously outputting a stored one of said monochrome display image and said digital signals to said flat panel display at an outgoing video rate.

2. The electronic control system of claim 1, wherein said universal video input selector means is comprised of any one of plural plug-in connectors including 15 pin VGA, BNC, and RCA type connectors, each of which has a unique code identifying said any one video type of said video signal.

3. An electronic control system receiving a video signal from a video signal source for visual presentation on a flat panel display, which comprises:

video input connector means for receiving composite and component video signals, and for generating a first code indicating a video type of said video signal;

composite video converter means in electrical communication with said video input connector means for separating chrominance signals and luminance signals from said video signal when said video type is composite;

video input selector means in electrical communication with said video input connector means and said composite video converter means for selecting color chrominance signals and said luminance signals if said video type is composite and for selecting said component video signals if said video type is component;

synchronization signal separation means in electrical communication with said video input connector means, said composite video converter means and said video input selector means for extracting horizontal synchronization signals and vertical synchronization signals from said video signal as required by said video type;

A/D converter means in electrical communication with said video input selector means for receiving said chrominance signals and said luminance signals from said video input selector means to produce digital signals;

color to monochrome reduction means in electrical communication with said A/D converter means and receiving said digital signals for mixing said digital signals in accordance with weighting formulas to provide color-to-monochrome transition signals when said video signal is a color signal and said flat panel display is a monochrome display, and otherwise passing said digital signals through without reduction;

frame buffer means in electrical communication with said color-to-monochrome reduction means and said A/D converter means for storing received ones of said digital signals and said color-to-monochrome transition signals at a first data and asynchronously outputting said received ones at a second data rate compatible with said flat panel display;

microprocessor means in electrical communication with said video input connector means, said composite video converter means, said video input selector means, said synchronization signal separation means, said A/D converter means, and said color-to-monochrome reduction means, and receiving said first code and a second code, for determining video format of said video signal and a flat panel display type, and for controlling operation of said electronic control means, and for supplying said weighting formulas to said color-to-monochrome reduction means;

pixel clock generator means in electrical communication with said microprocessor means, said synchronization signal separation means, and said A/D converter means, and responsive to said horizontal synchronization signals, said vertical synchronization signals, and said microprocessor means for generating pixel clock signals which are synchronized to said horizontal synchronization signals and supplied to said A/D converter means to control processing of said video signal;

frame buffer input control means in electrical communication with said synchronization signal separation means, said frame buffer means, said pixel clock generator means, and said microprocessor means for controlling storage of said digital signals and said color-to-monochrome transition signals into said frame buffer means;

flat panel timing generator means in electrical communication with said microprocessor means, said frame buffer input control means, said pixel clock generator means, and said synchronization signal separation means for generating output control timing signals to drive said flat panel display, fit an image on said flat panel display, and control power sequencing in turning said electronic control system on and off as said video signal is received and interrupted;

image size/position control means in electrical communication with said microprocessor means, said frame buffer means, and said flat panel timing generator means for generating image control signals to control size, position and orientation of a video image presented on said flat panel display;

frame buffer output control means in electrical communication with said microprocessor means, said frame buffer means, and said image size/position control means for controlling addressing and output data rate of said received ones stored in said frame buffer means;

power circuit means in electrical communication with said microprocessor means for supplying power-up voltages to said electronic control system; and flat panel interface module means in electrical communication with said microprocessor means, said flat panel timing generator means, said power circuit means, and said frame buffer means, and receiving said received ones from said frame buffer means at said second data rate, said output control timing signals from said flat panel timing generator means, and a power-up voltage from said power circuit means, for routing said received ones, said output control timing signals, and said power-up voltage to said flat panel display system, and for supplying said second code to said microprocessor means to identify said flat panel display type.

4. The electronic control system of claim 3, wherein said synchronization signal separation means includes a synchronization signal detector for locking onto said horizontal synchronization signals and said vertical synchronization signals.

5. The electronic control system of claim 3, wherein said video input connector means is a plug-in module which may be interchanged with selected ones of plural other plug-in modules to accommodate any type and format of said video signal.

6. The electronic control system of claim 3, wherein said digital signals are comprised of red, green and blue color signals.

7. The electronic control system of claim 3, wherein said video input connector means includes a selectably variable voltage reference to accommodate a wide range of amplitudes of said video signals.

8. The electronic control system of claim 3, wherein said frame buffer means is comprised of plug-in frame buffer modules of varying bit length and frame size to accommodate a wide variety of video formats.

9. The electronic control system of claim 3, wherein said electronic control system includes user controls in electrical communication with said microprocessor means for changing said weighting formulas and varying image contrast, position, brightness, and orientation, and shrinking and expanding said image on said flat panel display.

10. The electronic control system of claim 9, wherein said user controls are comprised of analog controls, digital controls and configuration switches.

11. The electronic control system of claim 3, wherein said first data rate is an incoming video data rate and said second data rate is an asynchronous outgoing flat panel display data rate.

12. The electronic control system of claim 3, wherein said A/D converter means is comprised of a pair of A/D converters per video color signal, wherein one of said pair of A/D converters digitizes even pixels and another of said pair of A/D converters digitizes odd pixels for accommodating high data rates.

13. The electronic control system of claim 3, wherein said video types include VGA with said vertical synchronization signals and said horizontal synchronization signals separated, RS-170/RS-343 sync-on green, RS-170/RS-343 RGB separate composite sync, composite NTSC and PAL types, and said video formats include NTSC, PAL, HDTV, SECAM, XGA, SVGA, RGB, VGA 640×480 Graphics, VGA 80×25 Text, and VGA 640×350 Graphics.

14. The electronic control system of claim 3, wherein said microprocessor means determines said video formats on basis of number of said horizontal synchronization signals that are detected by said synchronization signal separation means for each of said vertical synchronization signals detected by said synchronization signal separation means, and polarity of said vertical synchronization signals and said horizontal synchronization signals.

15. The electronic control system of claim 3, wherein said electronic control system accommodates video resolutions up to at least 2048×2048 rows and columns.

16. The electronic control system of claim 3, wherein said video input connector means may be any one of a 15 pin VGA, BNC, or RCA type connectors.

17. The electronic control system of claim 3, wherein said flat panel interface module means is a plug-in module which may be interchanged with any selected one of plural other plug-in modules to accommodate any type of said flat panel display.

18. The electronic control system of claim 17, wherein said plug-in module electrically communicates with any one of a color or monochrome LCD, electroluminescent, gas plasma or FED flat panel display.

19. The electronic control system of claim 3 wherein said second code identifies any one of at least 256 different flat panel display types.

20. The electronic control system of claim 3, wherein said video signal may be any one of interlaced and non-interlaced video signals.

21. A system for controlling size, position and orientation of a video image presented on a flat panel display, and in electrical communication with a memory system having stored therein said video image, and receiving a video signal from a video source, which comprises:

timing control means receiving said video signal from said video source at a video signal data rate for generating therefrom enable, vertical synchronization, horizontal synchronization, and first clock signals for driving said flat panel display, generating column start, row start, column replicate, and row replicate control signals for sizing said video image while maintaining a video signal resolution, and generating first control signals for reading said video image in said memory system;

image size/position control means in electrical communication with said timing control means and responsive to said column start, row start, column replicate, and row replicate control signals and said first control signals for generating output column address control signals, output row address control signals for said memory system, and a pixel clock signal; and frame buffer output control means in electrical communication with said timing control means, said memory system, said image size/position control means, and said flat panel display, and responsive to said pixel clock signal for reading said video image from said memory system.

22. An analog-to-digital converter system for digitizing a video signal received from a video source at a high data rate, which comprises:

timing control means in electrical communication with said video source and receiving said video signal for generating a pixel clock signal in synchronization with a horizontal synchronization signal of said video signal;

a first analog-to-digital converter in electrical communication with said timing control means and said video source, and receiving said video signal and said pixel clock signal, and generating therefrom odd pixel data signals;

an inverter in electrical communication with said timing control means, and receiving said pixel clock signal, and producing an inverted pixel clock signal;

a second analog-to-digital converter in electrical communication with said inverter and said video source, and receiving said inverted pixel clock signal and said video signal, and generating therefrom even pixel data signals; and a two-to-one multiplexer in electrical communication with said first analog-to-digital converter, said timing control means, said inverter, and said second analog-to-digital converter, and interlacing said odd pixel data signals and said even pixel data signals to produce a pixel signal representative of said video signal with no loss of resolution.

23. A system for reducing video color signals received from a video source to monochrome grey scale signals, which comprises:

digitizing means in electrical communication with said video source for digitizing said video color signals to produce a red digital color signal, a green digital color signal, and a blue digital color signal;

AND gate logic means in electrical communication with said digitizing means and receiving said red digital color signal, said green digital color signal, and said blue digital color signal, for producing first logic signals;

memory means in electrical communication with said AND gate logic means and having stored therein weighting values for mixing said red digital color signal, said green digital color signal and said blue digital color signal;

microprocessor means in electrical communication with said memory means for storing said weighting values; and OR gate logic means in electrical communication with said AND gate logic means and receiving said first logic signals to produce a monochrome grey scale video signal for presentation on said flat panel display.

24. A method of power-up and power down sequencing in an electronic control system for a flat panel display, said electronic control system having a first timing control system for generating digital synchronization signals, a second timing control system in electrical communication with said first timing control system for generating digital color signals and digital transition signals from a video signal received from a video source, a memory system in electrical communication with said first timing control system, said second timing control system, and said flat panel display, and having stored therein said digital color signals and said digital transition signals, and a backlight inverter power supply means in electrical communication with said first timing control system and said second timing control system, comprising the steps of:

supplying power to said flat panel display;

T1 seconds after supplying power to said flat panel display, applying synchronizations signals from said first timing control system to said flat panel display;

T2 seconds after supplying power to said flat panel display, applying said digital color signals and said digital transition signals from said memory system to said flat panel display;

T3 seconds after supplying power to said flat panel display, supplying power to said backlight inverter power supply means;

When power to said electronic control system is to be turned off, turning off power to said backlight inverter power supply means first;

T4 seconds after power to said backlight inverter power supply means is turned off, turning power to said memory system off;

T5 seconds after power to said backlight inverter power supply means is turned off, turning power to said first timing control system off, and

T6 seconds after power to said backlight inverter power supply means is turned off, turning power to said flat panel display off.

25. The method of claim 24, wherein the step of supplying power to said flat panel display occurs when said video signal is received, and the step of turning off power to said backlight inverter power supply means occurs when said video signal is no longer received.

26. An electronic control system receiving a video signal from a video signal source and forming therefrom a display image for visual presentation on a flat panel display, which comprises:

a first timing control system for identifying a video type and a video format, for separating chrominance signals, luminance signals, and synchronization signals from said video signal, for separating primary color signals from said chrominance signals, for separating vertical synchronization signals and horizontal synchronization signals from said synchronization signals, and for reducing said primary color signals into digital transition signals as required by said video type for storage at a video rate of said video signal to form a display image;

a second timing control system in electrical communication with said first timing control system and said flat panel display, and responsive to said vertical synchronization signals and said horizontal synchronization signals for determining image parameters and a flat panel video rate for said flat panel display, and for positioning, orienting, and sizing said display image; and a memory system in electrical communication with said first timing control system and said second timing control system for receiving said digital transition signal at said video rate, and asynchronously outputting said display image to said flat panel display at said flat panel video rate.

27. A method of receiving a video signal having any one of plural video types and any one of plural video formats, and displaying said video signal on a flat panel display, which includes the steps of:

identifying said one of plural video types and said one of plural video formats of said video signal;

separating luminance signals, chrominance signals, and synchronization signals from said one of plural video types, and red component signals, green component signals, and blue component signals from said chrominance signals, and vertical synchronization signals and horizontal synchronization signals from said synchronization signals;

reducing said red component signals, said green component signals, and said blue component signals in accordance with one of plural weighting formulas to produce a first monochrome video signal if said video signal is a color video signal and said flat panel display is a monochrome display, and otherwise passing said red component signals, said green component signals, and said blue component signals through without reduction;

in response to said vertical synchronization signals and said horizontal synchronization signals for said one of said plural video formats, and at a first video rate of said video signal, and as one of interlaced and non-interlaced signals, receiving said first monochrome video signal if said video signal is said color video signal and said flat panel display is said monochrome display, receiving said color video signal if said flat panel display is a color display, and receiving said video signal if said video signal is a second monochrome video signal and said flat panel display is said monochrome display or said color display, thereby forming a display image; and positioning, sizing, and orienting said display image while transferring said display image to said flat panel display asynchronously at a flat panel video rate.

28. The method of claim 27, wherein said display image is one or more of an upside down image form, a portrait image form, a mirror-image form, and a rotated image form.

29. The method of claim 27, wherein said plural weighting formulas are comprised of the following:

| | | | |
|---|---|---|---|
| NTSC Weighting | 5/16 Red | 9/16 Green | 2/16 Blue |
| Equal Weighting | 5/16 Red | 6/16 Green | 5/16 Blue |
| Green Only | 0/16 Red | 16/16 Green | 0/16 Blue |

30. The method of claim 27, wherein said plural video types are comprised of composite video and component video types, and said plural video formats are comprised of all RGB video formats including VGA, SVGA, XGA, NTSC, PAL, and SECAM.

31. The method of claim 27, wherein said flat panel display is one of LCD, electroluminescent, gas plasma, and FED display.

32. The method of claim 27, wherein said plural video types are up to 256 in number, and include VGA with separate HSYNC and VSYNC, RS-170/RS-343 RGB Sync-On-Green, RS-170/RS-343 RGB Separate Composite Sync, Composite Video (NTSC/PAL), and Computer Video (HDTV).

33. The method of claim 27, wherein said plural video formats include NTSC, PAL, HDTV, VGA 640×480 Graphics, VGA 80×25 Text, and VGA 640×350 Graphics.

34. The method of claim 27, wherein said first video rate is slower than and asynchronous to said flat panel video rate.

35. The method of claim 27, wherein said first video rate is faster than and asynchronous to said flat panel video rate.

36. The method of claim 27, wherein said step of reducing occurs in accordance with the following general equation:

Monochrome Data [bits 0–7] =

{Red Data [bits 0–7]} · {Red Weighting [bits 0–7]} +

{Green Data [bits 0–7]} · {Green Weighting [bits 0–7]} +

{Blue Data [bits 0–7]} · {Blue Weighting [bits 0–7]}, where "+" refers to a logical OR function and "●" refers to a logical AND function.

* * * * *

US005790096C1

(12) EX PARTE REEXAMINATION CERTIFICATE (7925th)

United States Patent

Hill, Jr.

(10) Number: US 5,790,096 C1

(45) Certificate Issued: Dec. 14, 2010

(54) AUTOMATED FLAT PANEL DISPLAY CONTROL SYSTEM FOR ACCOMODATING BROAD RANGE OF VIDEO TYPES AND FORMATS

(75) Inventor: Jacques R. Hill, Jr., Houston, TX (US)

(73) Assignee: LG Electronics Inc., Youngdungpo-ku, Seoul (KR)

Reexamination Request:
No. 90/009,572, Sep. 30, 2009

Reexamination Certificate for:

| | |
|---|---|
| Patent No.: | **5,790,096** |
| Issued: | **Aug. 4, 1998** |
| Appl. No.: | **08/707,338** |
| Filed: | **Sep. 3, 1996** |

(51) Int. Cl.
*G09G 5/02* (2006.01)
*G09G 3/20* (2006.01)

(52) U.S. Cl. ..... 345/600; 345/601; 348/441; 348/443; 375/240.01

(58) Field of Classification Search ..... None
See application file for complete search history.

(56) References Cited

U.S. PATENT DOCUMENTS

| | | | |
|---|---|---|---|
| 2,830,541 | A | 4/1958 | Higgins et al. |
| 3,657,478 | A | 4/1972 | Andrews |
| 3,691,295 | A | 9/1972 | Fisk |
| 3,715,470 | A | 2/1973 | Craig |
| 4,079,417 | A | 3/1978 | Scudder |
| 4,105,922 | A | 8/1978 | Lambert et al. |
| 4,148,069 | A | 4/1979 | Smiley et al. |
| 4,148,070 | A | 4/1979 | Taylor |
| 4,149,184 | A | 4/1979 | Giddings et al. |
| 4,149,185 | A | 4/1979 | Weinger |
| 4,158,200 | A | 6/1979 | Seitz et al. |
| 4,183,046 | A | 1/1980 | Dalke et al. |
| 4,218,710 | A | 8/1980 | Kashigi et al. |
| 4,236,175 | A | 11/1980 | Groothuis |
| 4,250,413 | A | 2/1981 | Kawasaki et al. |
| 4,251,755 | A | 2/1981 | Bryden |
| 4,306,166 | A | 12/1981 | Quandt |
| 4,323,922 | A | 4/1982 | Den Toonder et al. |
| 4,345,241 | A | 8/1982 | Takeuchi et al. |
| 4,362,020 | A | 12/1982 | Meacher et al. |
| 4,398,179 | A | 8/1983 | Kaneko |
| 4,417,135 | A | 11/1983 | Motoyama et al. |
| 4,436,397 | A | 3/1984 | Kobayashi |
| 4,439,759 | A | 3/1984 | Fleming et al. |
| 4,445,155 | A | 4/1984 | Takahashi et al. |

(Continued)

FOREIGN PATENT DOCUMENTS

DE 3720353 C2 1/1989

(Continued)

OTHER PUBLICATIONS

Chips, Datasheet for the 65535Higher Performance Flat Panel/CRT VGA Controller, Mar. 1994.

Cremonsi, A. et al. "An 8–Bit Two Step Flash A/D Coverter for Video Applications." IEEE Custom Integrated Circuit Conference. pp. 6.3/1–6.3/4, May 15–18, 1989.

(Continued)

*Primary Examiner*—Fred Ferris

(57) ABSTRACT

An electronics control system for full color and monochrome flat panel displays which automatically accommodates video signals of numerous types and formats, whether interlaced, non-interlaced, composite, or video signals with separated sync signals. Display of such video signals on a wide selection of flat panel display systems also is accommodated. Incoming and output video rates are asynchronous. Plug-in modules allow the system to convert video signals of numerous types and modes for display on any flat panel display system. Images are both automatically, and under user control, up-sized and down-sized, positioned and oriented to fit the flat panel display being used. Color images are automatically reduced to grey scale monochrome when a monochrome flat panel display is being used. Push-pull A/D converter circuitry for digitizing color video signals is used to reduce cost while conserving power. A further power saving feature provides for automatic power down when video reception is interrupted, and power up when the video reception is reacquired.

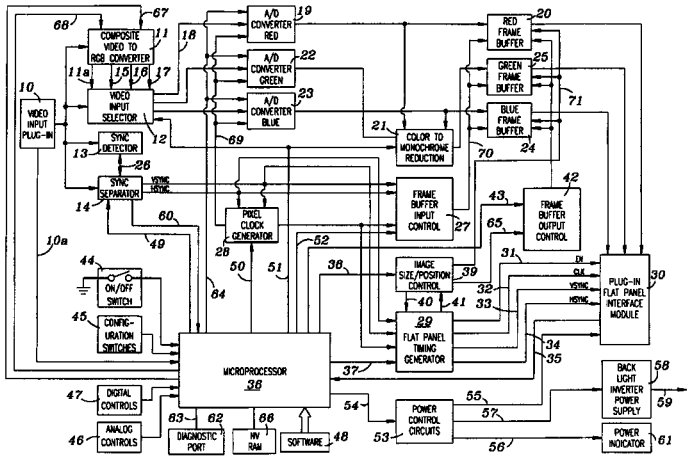

U.S. PATENT DOCUMENTS

| | | | |
|---|---|---|---|
| 4,464,652 | A | 8/1984 | Lapson et al. |
| 4,464,683 | A | 8/1984 | Thompson |
| 4,481,529 | A | 11/1984 | Kerling |
| 4,498,751 | A | 2/1985 | Goto |
| 4,550,315 | A | 10/1985 | Bass et al. |
| 4,613,852 | A | 9/1986 | Maruko |
| 4,641,157 | A | 2/1987 | Aoi |
| 4,641,262 | A | 2/1987 | Bryan et al. |
| 4,641,282 | A | 2/1987 | Ounuma |
| 4,651,146 | A | 3/1987 | Lucash et al. |
| 4,673,930 | A | 6/1987 | Bujalski et al. |
| 4,684,935 | A | 8/1987 | Fujisaku et al. |
| 4,688,031 | A | 8/1987 | Haggerty |
| 4,694,286 | A | 9/1987 | Bergstedt |
| 4,698,674 | A | 10/1987 | Bloom |
| 4,701,793 | A | 10/1987 | Den et al. |
| 4,703,317 | A | 10/1987 | Shiomi et al. |
| 4,710,806 | A | 12/1987 | Iwai et al. |
| 4,710,921 | A | 12/1987 | Ishidoh et al. |
| 4,721,951 | A | 1/1988 | Holler |
| 4,727,414 | A | 2/1988 | Ranf et al. |
| 4,739,312 | A | 4/1988 | Oudshoorn et al. |
| 4,742,350 | A | 5/1988 | Ko et al. |
| 4,751,496 | A | 6/1988 | Araki et al. |
| 4,751,502 | A | 6/1988 | Ishii et al. |
| 4,755,954 | A | 7/1988 | Netter |
| 4,761,740 | A | 8/1988 | Lipschutz |
| 4,763,283 | A | 8/1988 | Coutrot |
| 4,767,193 | A | 8/1988 | Ota et al. |
| 4,768,162 | A | 8/1988 | Nishimura |
| 4,789,831 | A | 12/1988 | Mayo |
| 4,794,932 | A | 1/1989 | Baba |
| 4,808,989 | A | 2/1989 | Tabata et al. |
| 4,811,200 | A | 3/1989 | Wagner et al. |
| 4,814,884 | A | 3/1989 | Johnson et al. |
| 4,825,143 | A | 4/1989 | Cheng |
| 4,827,255 | A | 5/1989 | Ishii |
| 4,827,942 | A | 5/1989 | Lipschutz |
| 4,837,710 | A | 6/1989 | Zelinsky et al. |
| 4,841,289 | A | 6/1989 | Kambayashi et al. |
| 4,843,573 | A | 6/1989 | Taylor et al. |
| 4,845,477 | A | 7/1989 | Shibata et al. |
| 4,845,644 | A | 7/1989 | Anthias et al. |
| 4,855,728 | A | 8/1989 | Mano et al. |
| 4,855,892 | A | 8/1989 | Lower |
| 4,868,563 | A | 9/1989 | Stair et al. |
| 4,869,626 | A | 9/1989 | Kosmowski |
| 4,872,002 | A | 10/1989 | Stewart et al. |
| 4,873,652 | A | 10/1989 | Pilat et al. |
| 4,907,146 | A | 3/1990 | Caporali |
| 4,914,439 | A | 4/1990 | Nakahashi et al. |
| 4,919,547 | A | 4/1990 | Schwartzman |
| 4,922,237 | A | 5/1990 | Inoue |
| 4,926,166 | A | 5/1990 | Fujisawa et al. |
| 4,929,933 | A | 5/1990 | McBeath et al. |
| 4,937,036 | A | 6/1990 | Beard et al. |
| 4,947,257 | A | 8/1990 | Fernandez et al. |
| 4,965,559 | A | 10/1990 | Dye |
| 4,967,373 | A | 10/1990 | Eilon |
| 4,977,398 | A | 12/1990 | Pleva et al. |
| 4,980,678 | A | 12/1990 | Zenda |
| RE33,532 | E | 2/1991 | Ishii |
| 4,990,902 | A | 2/1991 | Zenda |
| 4,990,904 | A | 2/1991 | Zenda |
| 4,994,914 | A | 2/1991 | Wiseman et al. |
| 4,998,165 | A | 3/1991 | Lindstrom |
| 4,999,628 | A | 3/1991 | Kakubo et al. |
| 5,005,013 | A | 4/1991 | Tsukamoto et al. |
| 5,030,896 | A | 7/1991 | Porter et al. |
| 5,062,001 | A | 10/1991 | Farwell et al. |
| 5,065,357 | A | 11/1991 | Shiraishi et al. |
| 5,068,649 | A | 11/1991 | Garrett |
| 5,077,553 | A | 12/1991 | Buzak |
| 5,078,476 | A | 1/1992 | Shin |
| 5,083,205 | A | 1/1992 | Arai |
| 5,089,886 | A | 2/1992 | Grandmougin |
| 5,091,718 | A | 2/1992 | Beatty |
| 5,119,086 | A | 6/1992 | Nishioka et al. |
| 5,127,744 | A | 7/1992 | White et al. |
| 5,128,782 | A | 7/1992 | Wood |
| 5,130,702 | A | 7/1992 | Lee |
| 5,130,814 | A | 7/1992 | Spencer |
| 5,138,305 | A | 8/1992 | Tomiyasu |
| 5,140,693 | A | 8/1992 | Ninomiya |
| 5,148,518 | A | 9/1992 | Inoue |
| 5,150,109 | A | 9/1992 | Berry |
| 5,153,574 | A | 10/1992 | Kondo |
| 5,153,577 | A | 10/1992 | Mackey et al. |
| 5,167,024 | A | 11/1992 | Smith et al. |
| 5,168,186 | A | 12/1992 | Yashiro |
| 5,168,270 | A | 12/1992 | Masumori et al. |
| 5,182,643 | A | 1/1993 | Futscher |
| 5,193,069 | A | 3/1993 | Furuya |
| 5,196,839 | A | 3/1993 | Johary et al. |
| 5,218,350 | A | 6/1993 | Bollman |
| 5,227,768 | A | 7/1993 | Beckett et al. |
| 5,227,882 | A | 7/1993 | Kato |
| 5,245,327 | A | 9/1993 | Pleva et al. |
| 5,247,286 | A | 9/1993 | Ishikawa |
| 5,247,300 | A | 9/1993 | Sohn |
| 5,250,948 | A | 10/1993 | Berstein et al. |
| 5,267,045 | A | 11/1993 | Stroomer |
| 5,268,676 | A | 12/1993 | Asprey et al. |
| 5,268,682 | A | 12/1993 | Yang et al. |
| 5,282,152 | A | 1/1994 | Caviasca et al. |
| 5,285,192 | A | 2/1994 | Johary et al. |
| 5,293,485 | A | 3/1994 | Zenda |
| 5,295,192 | A | 3/1994 | Hamada et al. |
| 5,299,306 | A | 3/1994 | Asprey |
| 5,313,225 | A | 5/1994 | Miyadera |
| 5,321,425 | A | 6/1994 | Chia et al. |
| 5,323,171 | A | 6/1994 | Yokouchi et al. |
| 5,325,287 | A | 6/1994 | Spahr et al. |
| 5,327,240 | A | 7/1994 | Golston et al. |
| 5,327,243 | A | 7/1994 | Maietta et al. |
| 5,334,992 | A | 8/1994 | Rochat et al. |
| 5,337,068 | A | 8/1994 | Stewart et al. |
| 5,375,209 | A | 12/1994 | Maher et al. |
| 5,381,161 | A | 1/1995 | Sasaki et al. |
| 5,389,952 | A | 2/1995 | Kikinis |
| 5,396,635 | A | 3/1995 | Fung |
| 5,400,051 | A | 3/1995 | Krueger |
| 5,400,053 | A | 3/1995 | Johary et al. |
| 5,404,150 | A | 4/1995 | Murata |
| 5,406,308 | A | 4/1995 | Shiki |
| 5,418,900 | A | 5/1995 | Yoshinaga |
| 5,442,371 | A | 8/1995 | Miller et al. |
| 5,442,372 | A | 8/1995 | Shiki |
| 5,442,375 | A | 8/1995 | Wojaczynski et al. |
| 5,446,496 | A | 8/1995 | Foster et al. |
| 5,459,484 | A | 10/1995 | Nguyen |
| 5,461,397 | A | 10/1995 | Zhang et al. |
| 5,475,402 | A | 12/1995 | Hijikata |
| 5,491,496 | A | 2/1996 | Tomiyasu |
| 5,491,561 | A | 2/1996 | Fukuda |
| 5,508,714 | A | 4/1996 | Zenda |
| 5,511,201 | A | 4/1996 | Kamimaki et al. |
| 5,532,854 | A | 7/1996 | Fergason |
| 5,534,883 | A | 7/1996 | Koh |
| 5,541,745 | A | 7/1996 | Fergason |
| 5,546,105 | A | 8/1996 | Leak |

| | | | |
|---|---|---|---|
| 5,552,800 | A | 9/1996 | Uchikoga et al. |
| 5,563,624 | A | 10/1996 | Imamura |
| 5,563,955 | A | 10/1996 | Bass et al. |
| 5,576,601 | A | 11/1996 | Koenck et al. |
| 5,576,723 | A | 11/1996 | Asprey |
| 5,576,738 | A | 11/1996 | Anwyl et al. |
| 5,587,744 | A | 12/1996 | Tanaka |
| 5,589,848 | A | 12/1996 | Shimizu |
| 5,600,347 | A | 2/1997 | Thompson et al. |
| 5,606,346 | A | 2/1997 | Kai et al. |
| 5,606,348 | A | 2/1997 | Chiu |
| 5,608,418 | A | 3/1997 | McNally |
| 5,631,707 | A | 5/1997 | Errico |
| 5,636,250 | A | 6/1997 | Scarpa |
| 5,657,047 | A | 8/1997 | Tarolli |
| 5,666,540 | A | 9/1997 | Hagiwara et al. |
| 5,703,629 | A | 12/1997 | Mermelstein et al. |
| 5,717,422 | A | 2/1998 | Fergason |
| 5,719,592 | A | 2/1998 | Misawa |
| 5,731,794 | A | 3/1998 | Miyazawa |
| 5,757,520 | A | 5/1998 | Takashima |
| 5,760,753 | A | 6/1998 | Hayashi |
| 5,767,828 | A | 6/1998 | McKnight |
| 5,771,040 | A | 6/1998 | Kim |
| 5,771,373 | A | 6/1998 | Kau et al. |
| 5,777,611 | A | 7/1998 | Song |
| 5,809,369 | A | 9/1998 | Furuya et al. |
| 5,812,149 | A | 9/1998 | Kawasaki et al. |
| 5,818,172 | A | 10/1998 | Lee |
| 5,821,913 | A | 10/1998 | Mamiya |
| 5,838,385 | A | 11/1998 | Reder et al. |
| 5,857,149 | A | 1/1999 | Suzuki |
| 5,859,626 | A | 1/1999 | Kawamura |
| 5,864,347 | A | 1/1999 | Inoue |
| 5,867,137 | A | 2/1999 | Sugiyama |
| 5,883,676 | A | 3/1999 | Miyazaki et al. |
| 5,926,174 | A | 7/1999 | Shibamiya et al. |
| 5,956,049 | A | 9/1999 | Cheng |
| 5,963,344 | A | 10/1999 | Morita et al. |
| 6,002,810 | A | 12/1999 | Wakisawa et al. |
| 6,023,252 | A | 2/2000 | Yano et al. |
| 6,078,317 | A | 6/2000 | Sawada |
| 6,154,193 | A | 11/2000 | Wakimoto |
| 6,215,467 | B1 | 4/2001 | Suga et al. |
| 6,310,599 | B1 | 10/2001 | Bril et al. |
| 6,310,602 | B1 | 10/2001 | Kasai et al. |
| RE37,551 | E | 2/2002 | Shiki |
| 6,348,910 | B1 | 2/2002 | Yamamoto et al. |
| 6,378,068 | B1 | 4/2002 | Foster et al. |
| 6,397,338 | B2 | 5/2002 | Shay |
| 6,441,858 | B1 | 8/2002 | Nakamoto et al. |
| 6,587,120 | B2 | 7/2003 | Kasai et al. |

FOREIGN PATENT DOCUMENTS

| | | | |
|---|---|---|---|
| EP | 175935 | A2 | 4/1986 |
| EP | 265209 | B1 | 4/1988 |
| EP | 281502 | A1 | 9/1988 |
| EP | 364222 | A3 | 4/1990 |
| EP | 456012 | A2 | 11/1991 |
| EP | 493893 | A3 | 12/1991 |
| EP | 496536 | A2 | 7/1992 |
| EP | 502600 | A3 | 9/1992 |
| EP | 565914 | A1 | 3/1993 |
| EP | 553963 | A2 | 8/1993 |
| EP | 572024 | A3 | 12/1993 |
| EP | 730371 | A3 | 9/1996 |
| EP | 803796 | A2 | 10/1997 |
| GB | 2202702 | A | 9/1988 |
| GB | 2285163 | A | 6/1995 |
| JP | 58106622 | U | 6/1983 |
| JP | 59112371 | A | 6/1984 |
| JP | 61009634 | A | 1/1986 |
| JP | 1139296 | U | 9/1989 |
| JP | 2004221 | U | 1/1990 |
| JP | 2105112 | A | 4/1990 |
| JP | 2280587 | A | 11/1990 |
| JP | 3053293 | Y2 | 3/1991 |
| JP | 3105879 | U | 11/1991 |
| JP | 03293318 | B2 | 12/1991 |
| JP | 03296090 | B2 | 12/1991 |
| JP | 4012393 | A | 1/1992 |
| JP | 4050996 | A | 2/1992 |
| JP | 4163523 | A | 6/1992 |
| JP | 4320295 | A | 11/1992 |
| JP | 4326412 | A | 11/1992 |
| JP | 5066385 | A | 3/1993 |
| JP | 5188920 | A | 7/1993 |
| JP | 7013128 | A | 1/1995 |
| JP | 7104711 | A | 4/1995 |
| JP | 8327976 | A | 2/1996 |
| JP | 8101668 | A | 4/1996 |
| JP | 8149405 | A | 6/1996 |
| JP | 8313868 | A | 11/1996 |
| JP | 9090317 | A | 4/1997 |

OTHER PUBLICATIONS

Dang, H., Improved Power–On Sequence for the Notebook Computers,: IBM Technical Disclosure Bulletin, Mar. 1, 1996.

Dechamps, J. et al., "Flat Screen Plasma Displays," Revue Technique Thomson–CSF, Mar. 1994.

Fukuda, J., "Variable Scale Vertical Expansion for Flat Panels," IBM Technical Disclosure Bulletin vol. 38 Issue 1, pp. 157–166, Jan. 1, 1995.

Graham, A. et al., "Colour and Grayscale in Ferroelectric Liquid Crystal Displays," IEEE Colloquium on Novel Display Technologies, pp. 5/1–5/6, Jun. 21, 1995.

Guthrie, C., "Power–On Sequencing for Liquid–Crystal Displays," Information Display vol. 12 No. 2, pp. 16–19, May 11, 1996.

Hasegawa, H. et al., "A 1.5v 8b 8 MW Bicmos Video A/D Converter," IEEE International Solid State Circuits Conference, pp. 322–323, 467, Feb. 8–10, 1996.

Hirano, Y. et al., "Backlight Control Method for Liquid Crystal Display," IBM Technical Disclosure Bulletin, May 1, 1994.

Itoh, H. et al., "No Screen Garbage Power On/Off Method of Backlight Liquid Crystal Display," IBM Technical Disclosure Bulletin vol. 37 No. 12, pp. 99–101, Dec. 1994.

Kobayashi, Y. et al., "Thin–Film Transistor/Liquid Crystal Display Interface with Multiple Digital–to–Analog Converters," IBM Technical Disclosure Bulletin vol. 38 No. 2, pp. 47–78, Feb. 1, 1995.

Krunz, M., "Statistical Characteristics and Multiplexing of MPEG Streams," IEEE INFOCOM '95 Fourteenth Annual Joint Conference of the IEEE Computer and Communications Societies. Bringing Information to People. Proceedings vol. 2, pp. 455–462, Apr. 2–6, 1995.

Lelah, A. et al., "A 25 MHz 162–Output S/H Analog Column Driver for LCDs," IEEE International Solid State Circuits Conference, pp. 120, 121, 262, Feb. 19–21, 1992.

Pleshko, P., "Halftone Gray Scale For Matrix–Addressed Displays," Information Display vol. 6 Issue 10, pp. 10–ff, Oct. 1990.

Wu, X., "YIQ Vector Quantization in a New Color Palette," Architecture IEEE Transactions on Image Processing vol. 5 Issue 2, pp. 321–329, Feb. 1996.

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 24 and 25 is confirmed.

Claims 1-23 and 26-36 were not reexamined.

* * * * *